US006957883B2

(12) United States Patent
Yamaguchi et al.

(10) Patent No.: US 6,957,883 B2
(45) Date of Patent: Oct. 25, 2005

(54) LIQUID DISCHARGE RECORDING HEAD

(75) Inventors: Yukuo Yamaguchi, Tokyo (JP); Yutaka Koizumi, Kanagawa (JP); Mikiya Umeyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/361,615

(22) Filed: Feb. 11, 2003

(65) Prior Publication Data

US 2003/0156171 A1 Aug. 21, 2003

(30) Foreign Application Priority Data

Feb. 15, 2002 (JP) ..... 2002-039241

(51) Int. Cl.[7] ..... B41J 2/175
(52) U.S. Cl. ..... 347/87
(58) Field of Search ..... 347/49, 85, 86, 347/87

(56) References Cited

U.S. PATENT DOCUMENTS 5,448,274 A * 9/1995 Hirabayashi et al. ..... 347/86
5,805,187 A * 9/1998 Sasaki ..... 347/86
6,390,601 B1 * 5/2002 Morita et al. ..... 347/49
2003/0016278 A1 1/2003 Yamaguchi et al.

OTHER PUBLICATIONS

U.S. Appl. No. 10/356,509, filed Feb. 2003, Yamaguchi et al.
U.S. Appl. No. 10/359,055, filed Feb. 2003, Yamaguchi et al.
U.S. Appl. No. 10/361,621, filed Feb. 2003, Yamaguchi et al.
U.S. Appl. No. 10/366,477, filed Feb. 2003, Yamaguchi et al.

* cited by examiner

*Primary Examiner*—Anh T. N. Vo
(74) *Attorney, Agent, or Firm*—Fitzpatrick, Cella, Harper & Scinto

(57) ABSTRACT

A liquid discharge recording head is formed by bonding a recording unit, having plural recording elements for discharging recording liquid, with a recording liquid supply supporting member used for supplying recording liquid to the recording unit. The recording liquid supply supporting member is provided with at least one first snap fitting extending substantially in the same direction as the bonding direction of the recording liquid supply supporting member and the recording unit, and at least one second snap fitting extending in a direction intersecting the extended direction of the first snap fitting. The recording unit is provided with at least one first receiving portion engaging with the first engaging portion formed for the first snap fitting, and at least one second receiving portion engaging with the second engaging portion formed for the second snap fitting.

9 Claims, 19 Drawing Sheets

LIQUID DISCHARGE RECORDING HEAD

BACKGROUND OF THE INVENTION

1. Field of the Invention

The present invention relates to a liquid discharge recording head that forms liquid droplets by discharging liquid, such as recording liquid, from discharge ports (orifices).

2. Related Background Art

A recording apparatus that is provided with functions such as those of a printer, a copying machine, a facsimile equipment, or the like, or a recording apparatus that is used as the output equipment for complex electronic equipment or a work station including a computer or a word processor, is structured to record information, such as images, on a recording sheet, a thin plastic plate, or other recording medium in accordance with recording information. Recording apparatuses of the kind are classified into ink jet type, wire-dot type, thermal type, laser beam type, and others according to the recording method that such recording apparatus adopts.

Here, in accordance with FIG. 21 to FIG. 24, the description will be made of one modal example of a liquid discharge recording head in which recording liquid is supplied from a recording liquid storing chamber that is set apart, and also, one modal example of a liquid discharge recording head having an exchangeable recording liquid storing unit mounted thereon, as typical structures of the liquid discharge recording head of the ink jet type.

FIG. 21 and FIG. 22 are views that illustrate the mode of the liquid discharge recording head in which recording liquid is supplied from an external recording liquid storing chamber through a tube member or the like. FIG. 21 is a partially broken perspective view that shows the liquid discharge recording head. FIG. 22 is an exploded perspective view that shows the liquid discharge recording head.

In the recording unit 1140, the recording element base plate 1107 provided with recording elements 1106, which are energy generating members for discharging recording liquid, is die bonded to the supporting base plate 1110 of aluminum, ceramics, or the like.

On the other hand, the wiring base plate 1108 is bonded to the supporting base plate 1110, beside the recording element base plate 1107, in order to make electrical connection with the liquid discharge recording apparatus, and the recording element base plate 1107 and the wiring base plate 1108 are electrically connected by wire bonding, lead bonding, or the like.

In this respect, on the recording element base plate 1107, driving shift registers and a wiring pattern are arranged in addition to the recordingelements. These are incorporated in advance on the recording element base plate 1107 together with the recording elements by silicon formation technologies and techniques.

Also, for the wiring base plate 1108, a contact pad (not shown) is formed to make electrical connection with the liquid discharge recording apparatus. The recessed flow path 1103 and the liquid chamber 1104 formed on the ceiling plate 1100 are provided for the orifice plate 1101, and communicated with the fine discharge port group 1102 for discharging liquid droplets.

The ceiling plate 1100 is fixed to the recording element base plate 1107 by a flat spring 1105 or some other pressure means or by bonding means, such as a bonding agent. The liquid flow paths 1103 and the liquid chamber 1104 are partitioned. Also, the orifice plate 1101 is aligned and fixed to the bonding end faces of the ceiling plate 1100 and recording element base plate 1107.

The flow path formation member 1120 for supplying recording liquid to the liquid chamber 1104 in the ceiling plate 1100 is connected with the supply port 1122 arranged for the upper face of the ceiling plate 1100. Further, a porous member 1121 is bonded to the side where the flow path formation member 1120 faces the bonding portion of the ceiling plate 1100, thus removing impurities, dust particles, and other matter contained in the recording liquid or the like.

Here, as described above, besides the mode in which the orifice plate 1101 is bonded as a separate member, there is a mode in which it is formed by patterning as employed in semiconductor film formation.

On the other hand, the recording liquid supply member 1150 is formed by the frame member 1130 having a common liquid chamber (not shown) provided therefor to retain recording liquid therein. The frame member 1130 functions as a housing to hold the recording unit 1140.

Then, the recording unit 1140 is positioned and fixed to the frame member 1130 by use of screws 1131 or bonding means, such as a bonding agent. Further, the bonding portion thereof is sealed by sealant or the like, thus airtightly closing it.

When recording liquid is supplied to the common liquid chamber from an external recording liquid storing tank (not shown) for the liquid discharge recording head of the kind, liquid supply is effectuated through the supply portion 1132 and exhaust portion 1133 arranged in the side face of the frame member 1130. In other words, a needle-type member, such as a needle, which is provided for the liquid discharge recording apparatus, is arranged to penetrate the supply portion 1132 and the exhaust portion 1133, respectively, and then, the structure is arranged so that the air in the common liquid chamber is suctioned and exhausted through the exhaust portion 1133 to increase the negative pressure in the common liquid chamber, thus suctioning recording liquid into the common liquid chamber from the external recording liquid storing tank through the supply portion 1132.

As described above, recording liquid retained in the common liquid chamber is supplied to the nozzle portion through the flow path formation member 1120 and the ceiling plate 1100. The liquid discharge recording head shown in FIG. 21 is of the mode in which a single recording element base plate 1107 is bonded to the supporting base plate 1110. However, as another mode of the liquid discharge recording head, there is the one in which plural recording element base plates 1107 are bonded to the supporting base plate 1110. Also, in the case of a liquid discharge recording head in which a single recording element base plate 1107 is assembled, there are the liquid discharge recording apparatus in which a single liquid discharge recording head is mounted thereon, and the liquid discharge recording apparatus in which plural liquid discharge recording heads are mounted thereon.

FIG. 23 and FIG. 24 are views that illustrate the mode of the liquid discharge recording head in which an exchangeable recording liquid storing unit is mounted thereon. FIG. 23 is a perspective view that schematically shows the liquid discharge recording head. FIG. 24 is a plan view that shows the upper part of the liquid discharge recording head. As shown in FIGS. 23 and 24, the liquid discharge recording head on which an exchangeable recording liquid storing unit is mounted is formed by connecting the recording unit 1201 and the holder 1202. Then, the exchangeable recording liquid storing unit 1301 is made freely attachable to and detachable from the holder 1202. Then, recording liquid is supplied to the recording unit 1201 when the exchangeable recording liquid storing unit 1301 is mounted on the holder 1202, and then, the supply port 1302 of the exchangeable recording liquid storing unit 1301 is connected with the porous member 1203, which is arranged for the recording unit 1201 to trap dust particles.

As described above, the liquid discharge recording head that uses an electrothermal converting element has a pressure chamber in which the electrothermal converting element is provided, and then, thermal energy is given to the recording liquid by the application of electric pulses that serve as electric signals. Thus, the bubbling pressure at the time of bubbling recording liquid (at the time of giving film boiling thereto), which is generated by a phase change of the recording liquid, is utilized for discharging recording liquid droplets.

Further, for the liquid discharge recording head that uses an electrothermal converting method, there are the method in which recording liquid is discharged in parallel to the base plate having the electrothermal converting element arranged therefor (that is, an edge-shooter; see FIG. 21), and the method in which recording liquid is discharged perpendicularly to the base plate having the electrothermal converting element arranged therefor (that is, a side shooter).

Here, for the liquid discharge recording head thus structured, there is a fear that the recording performance will deteriorate due to abnormal conditions that may be brought about in the electric pulses that become electric signals, the bubbling condition of the recording liquid, or the like, when the temperature of the recording element base plate becomes excessively high during recording operation. Therefore, it is generally practiced to provide some heat radiation means in the liquid discharge recording head.

For the edge shooter type liquid discharge recording head, for example, the supporting base plate, which is formed of aluminum, aluminum alloy, ceramics, or some other material that serves as a heat radiating member, is often bonded to the recording element base plate formed of an Si material as described earlier.

On the other hand, for the side shooter type liquid discharge recording head, there is a simple method in which heat is radiated by means of recording liquid discharged from the recording liquid retaining medium through the backside of the recording element base plate. Further, in the liquid discharge recording head of the side shooter type in which the temperature rises more readily due to the recording elements being arranged in high density, there is a method in which the-supporting base plate serves as the heat radiating member with a comparatively large contact arca, and the recording element base plate is bonded and fixed to such supporting base plate.

In recent years, ink jet recording apparatuses have been widely and rapidly developed and used in various fields. Moreover, the recording capacity of such apparatuses has been increased, for causing an increased consumption of recording liquid. Along with this, the demand is increasing rapidly for an ink jet recording apparatus having a larger capacity of recording liquid storage.

However, as described above, the liquid discharge recording head having the recording liquid storing portion integrally contained therein has automatically a limit to the capacity of recording liquid storage. Therefore, if a large amount of recording liquid should be consumed, it becomes necessary to replace the liquid discharge recording heads frequently, which is not only troublesome for the operator to carry on the operation, but also brings about the drawback that the consumption costs of expendables become higher.

To counteract this, if the capacity of the recording liquid storage is increased, the weight of the liquid discharge recording head becomes larger, making the inertia generated by the carriage scans larger accordingly, which not only spoils the stability of carriage scans so as to deteriorate printing quality, but also brings about the drawback that the liquid discharge recording apparatus becomes larger as a whole to accommodate the large recording liquid storing chamber mounted on the carriage.

Now, therefore, the liquid discharge recording head of the mode in which, while the weight of the recording liquid storage is restricted, the detachably mountable recording liquid storing unit, that is, the so-called cartridge holder member, is mounted and made easily exchangeable, is widelyused. With the structure that holds such a cartridge tank on the holder member, it becomes easier to replenish the recording liquid, and the operating cost of printing is made comparatively small. Also, it is possible to obtain an advantage that the space needed for containing the recording liquid is made smaller so that the liquid discharge recording apparatus can be downsized.

However, in the liquid discharge recording head of this type, it is necessary that the recording supply paths be connected when bonding the recording unit and the recording liquid storing unit. As a result, a sealing member and bonding process are needed, among others.

It is also necessary to arrange the structure so that bonding between the recording unit and the recording liquid storing unit should not be released to allow recording liquid in the recording liquid storing unit to leak, even when the liquid discharge recording head receives shocking force in such an event that the liquid discharge recording head is caused to drop off or the like. Furthermore, it is necessary to avoid such a problem that recording liquid may spread out from the connecting portion of the recording liquid supply paths or that bubbles are trapped at the junction of the recording liquid connectors, among some others.

Therefore, with a view to solving the problems enumerated above, the recording unit and recording liquid storing unit are bonded by screws or the like for fixing them strongly for the liquid discharge recording head of the mode in which the recording unit and the recording liquid storing unit are bonded. However, in terms of the head cost, such as the increased costs of parts, the increase steps of the manufacturing process, the process of inspection additionally needed, and reliability as well, this measure is not favorable after all.

On the other hand, for the liquid discharge recording head of the mode in which recording liquid is supplied from an external recording liquid storing chamber to the recording unit, that is, more precisely, recording liquid is supplied to the recording unit from an external recording liquid storing chamber through the recording liquid storing unit, which is bonded to the recording unit to retain recording liquid temporarily, there is a certain degree of freedom in the installing position of the external recording liquid storing chamber, which presents advantages, such as that the layout of the liquid discharge recording apparatus can be designed efficiently, and also, the capacity of the external recording liquid storing chamber can be made larger. Furthermore, in the mode in which the external recording liquid storing chamber and the liquid discharge recording head are connected by a tube member or the like, the structure is arranged to maintain the negative pressure in the liquid discharge recording head by the water head difference between the discharge port surface of the liquid discharge recording head and the water level of the external recording liquid storing chamber. Therefore, unlike the mode in which a negative pressure means is used, such as the recording liquid absorption type or mechanical type, or the one that adopts a pit-in recording supply, this structure can be arranged very simply to make it possible to structure the apparatus at lower costs as a whole.

As has been described, there are various modes of recording liquid supply for the liquid discharge recording head, and it has been practiced conventionally to provide the liquid discharge recording heads of various modes in agreement with the required specifications of the liquid discharge recording apparatuses.

Under such circumstances, various types of liquid discharge recording head groups are produced inevitably, necessitating enormous amounts of investments in facilities, and complicated production control and management, so that productivity is significantly deteriorated.

SUMMARY OF THE INVENTION

The present invention is designed with a view to solving the problems discussed above. It is an object of the invention to provide a highly reliable low-cost liquid discharge recording head having a structure capable of bonding a recording liquid supply supporting member and a recording unit simply and precisely, while attempting the sharable use of the recording unit with respect to the recording liquid supply supporting member for supplying recording liquid to the recording unit, which provides each different function, such as a recording liquid storing unit, a holder member for fixing and holding the so-called cartridge tank, or a recording liquid storing unit member for provisionally retaining recording liquid supplied from the outside. In order to achieve the aforesaid object, a liquid discharge recording head of the present invention is formed by bonding a recording unit having plural recording elements for discharging recording liquid, and a recording liquid supply supporting member used for supplying recording liquid to the recording unit, wherein the recording liquid supply supporting member is provided with at least one first snap fitting extended substantially in the same direction as the bonding direction of the recording liquid supply supporting member and the recording unit, and at least one second snap fitting extended in the direction intersecting the extended direction of the first snap fitting, and wherein the recording unit is provided with at least one first receiving portion engaging with a first engaging portion formed for the first snap fitting, and at least one second receiving portion engaging with a second engaging portion formed for the second snap fitting.

Also, a liquid discharge recording head of the present invention is formed by bonding a recording unit having plural recording elements for discharging recording liquid, and a recording liquid supply supporting member used for supplying recording liquid to the recording unit, wherein the recording unit is provided with at least one first snap fitting extended substantially in the same direction as the bonding direction of the recording liquid supply supporting member and the recording unit, and at least one second snap fitting extended in the direction intersecting the extended direction of the first snap fitting, and wherein the recording liquid supply supporting member is provided with at least one first receiving portion engaging with a first engaging portion formed for the first snap fitting, and at least one second receiving portion engaging with a second engaging portion formed for the second snap fitting.

As described above, the liquid discharge recording head of the invention is structured so that the recording unit and the recording liquid supply supporting member are bonded by engagement between the first and second snap fittings and the first and second receiving portions, respectively. Therefore, these members are bonded simply and reliably.

Also, the recording liquid supply supporting member and the recording unit are bonded in the direction in which the engaging direction of the first snap fitting and the first receiving portion and that of the second snap fitting and the second receiving portion intersect each other. Therefore, even if force is exerted in the direction in which either one of them is caused to be separated by the shocking force resulting from the dropping off of the liquid discharge recording head or the like, it is possible to make such force difficult to be exerted in the direction in which the other one of the engagements would be released, thus retaining the other engagement. Consequently, even in the case where shocking force is given by the dropping off of the liquid discharge recording head of the invention or the like, the recording unit and the recording unit supply supporting member are bonded strongly, thus preventing them from being separated.

Also, for the liquid discharge recording head of the invention, the extended direction of the first snap fitting may intersect the extended direction of the second snap fitting at an angle of 45° or more. Particularly, the extended direction of the first snap fitting may be substantially orthogonal to the extended direction of the second snap fitting. With the bonding directions by snap fittings intersecting at an angle of 45° or more, or orthogonally in particular, the bonding between the recording unit and the recording liquid supply supporting member becomes stronger and also more reliable against dropping shocks.

Also, the liquid discharge recording head of the invention is provided with a pair of first snap fittings and a pair of first receiving portions, and further, the liquid discharge recording head of the invention may be formed by bonding the recording unit with either the holding member for holding and fixing the storing tank that contains recording liquid therein, or the recording liquid storing unit member for provisionally retaining recording liquid supplied from the outside, as the recording liquid supply supporting member, in order to effectuate the sharable use of the recording unit, which functions as the core of recording liquid discharges.

Also, for the liquid discharge recording head of the invention, a sealing member may be nipped on the bonding portion between the recording liquid supply supporting member and the recording unit.

Also, the recording head of the invention may be provided with an elastic engaging portion that extends in the same direction as the first snap fitting, in the vicinity of the second snap fitting of the recording liquid supply supporting member.

BRIEF DESCRIPTION OF THE DRAWINGS

FIG. 9A shows the state in which needles are inserted into the joint rubbers; and FIG. 9B shows the state in which needles are not inserted.

FIG. 16A is a perspective view, observed from the side where the contact terminal wiring base plate is provided; FIG. 16B is a perspective view, observed from the rear side of the holder member.

DETAILED DESCRIPTION OF THE PREFERRED EMBODIMENTS

Next, with reference to the accompanying drawings, the description will be made of the embodiments in accordance with the present invention.

(First Embodiment)

Figure 1:
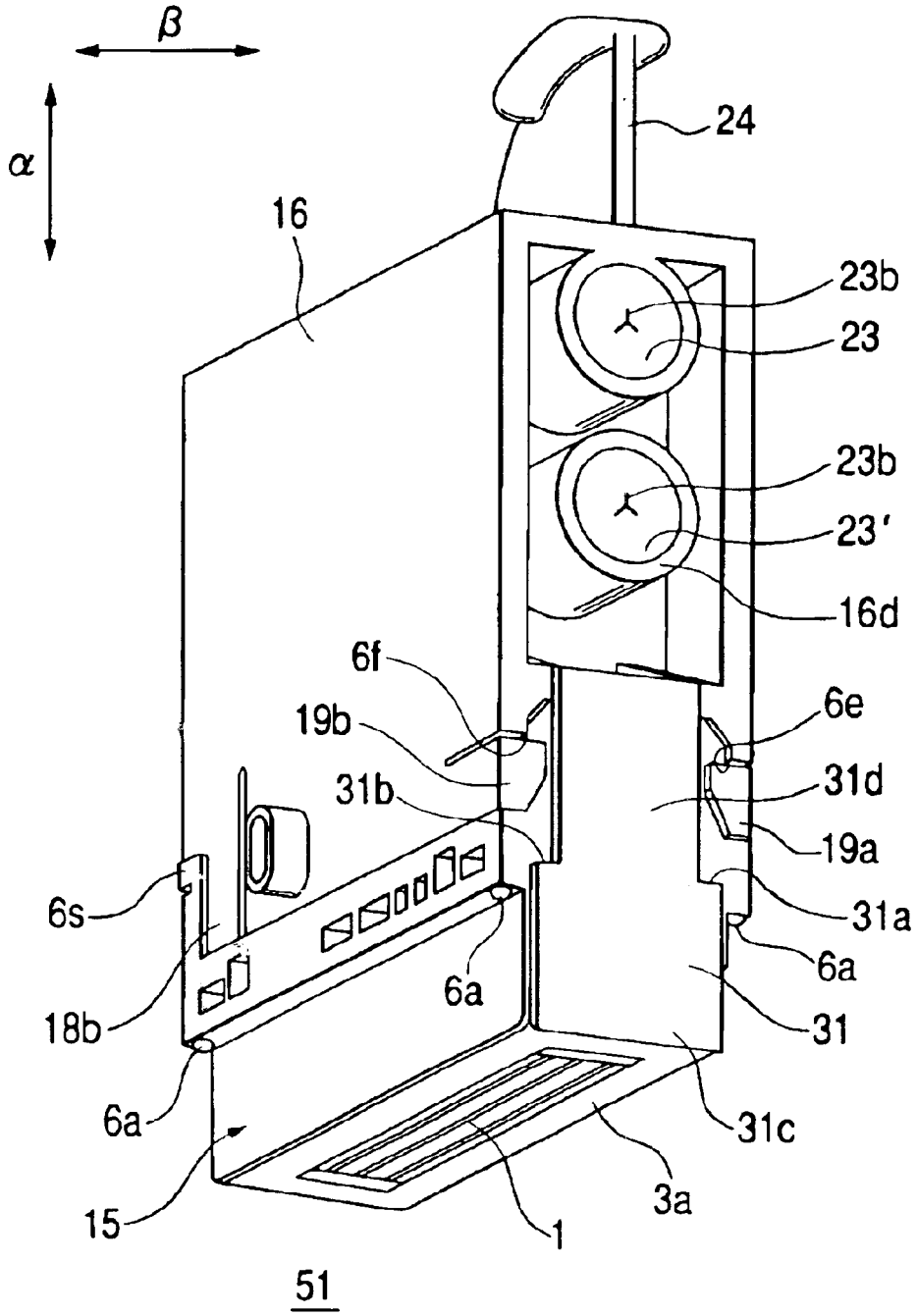
FIG. 1 is a perspective view that shows one example of the liquid discharge recording head in accordance with a first embodiment of the present invention, observed from the side at which a joint rubber is provided for supplying recording liquid.
Figure 2:
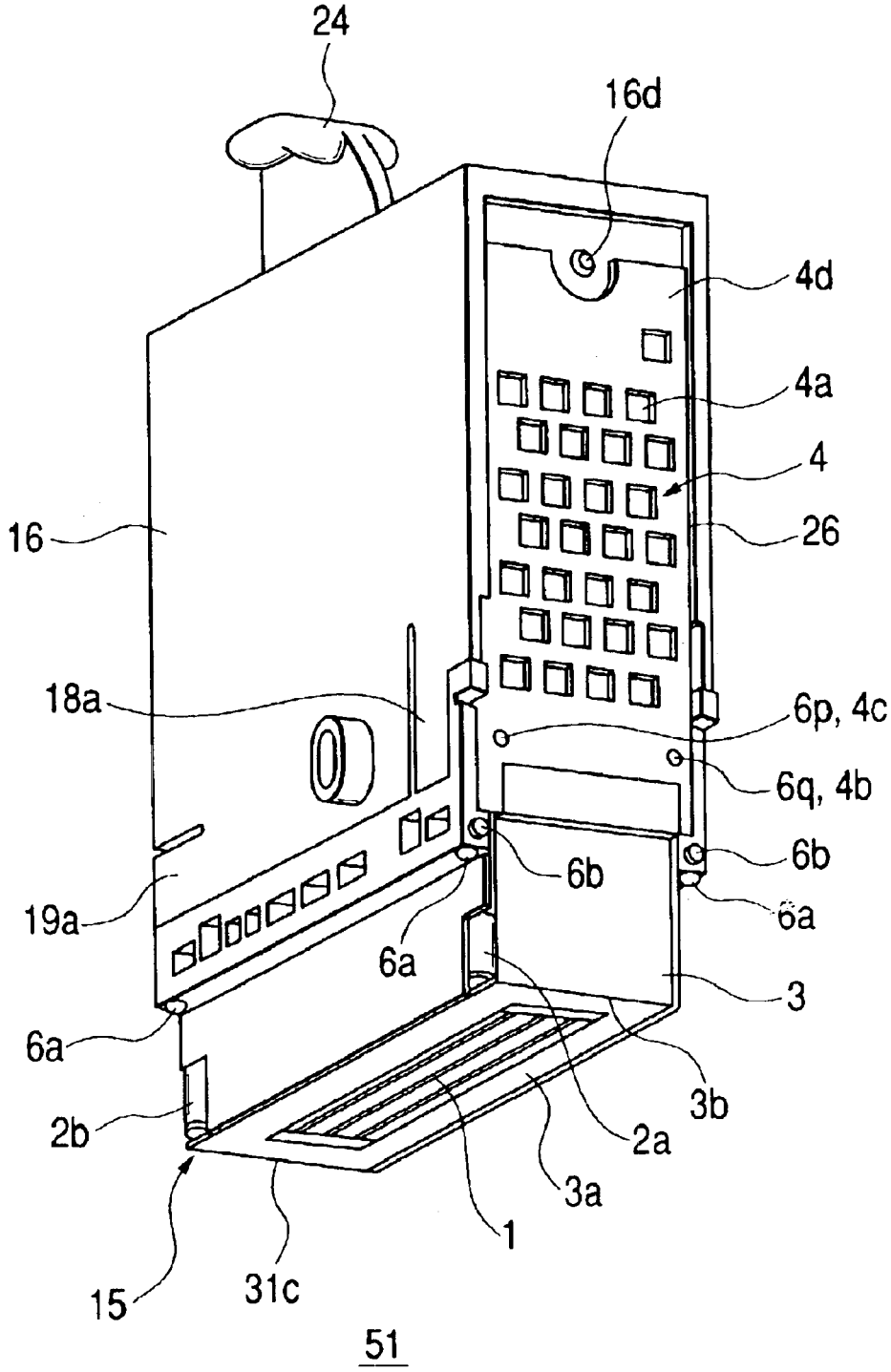
FIG. 2 is a perspective view that shows the liquid discharge recording head represented in FIG. 1, observed from the side at which the contact terminal wiring base plate is provided.
Figure 3:
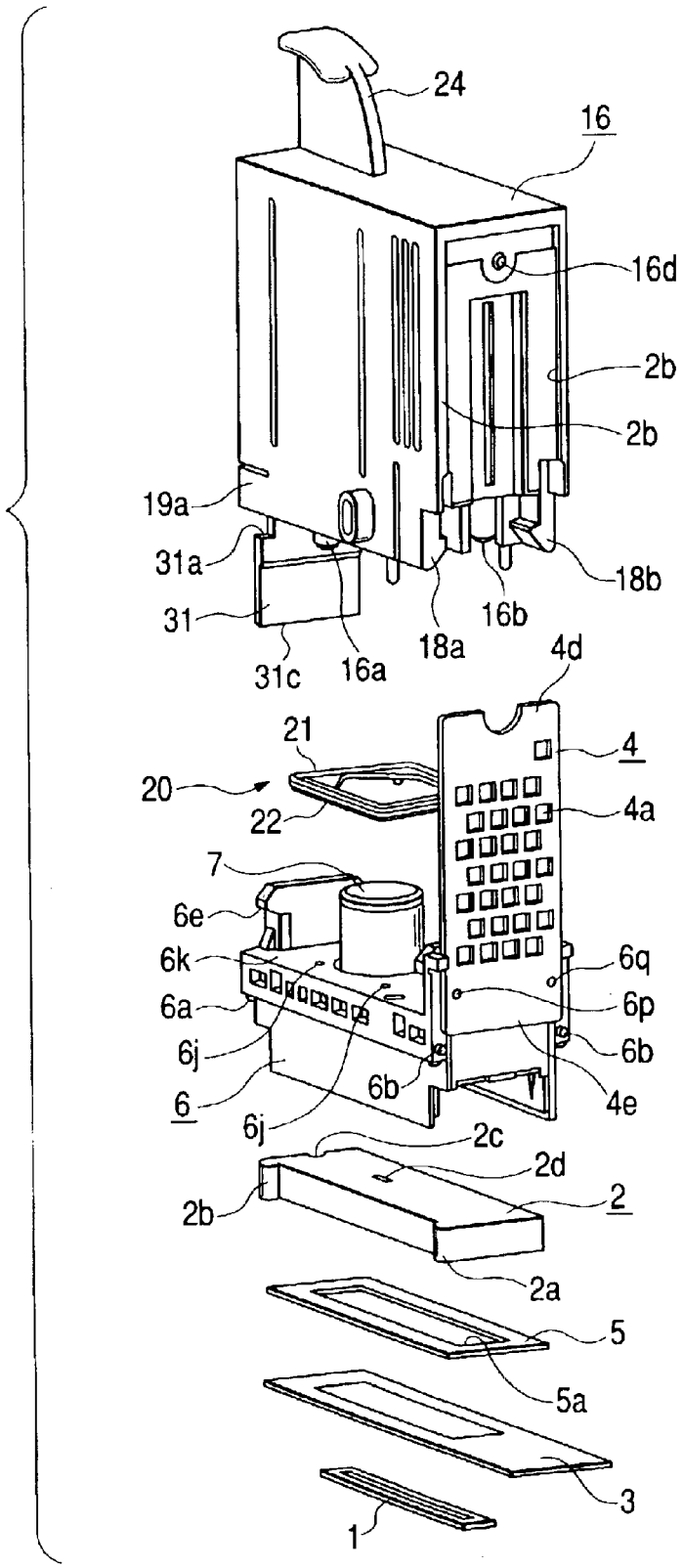
FIG. 3 is an exploded perspective view that shows the liquid discharge recording head represented in FIG. 1.
Figure 4A:
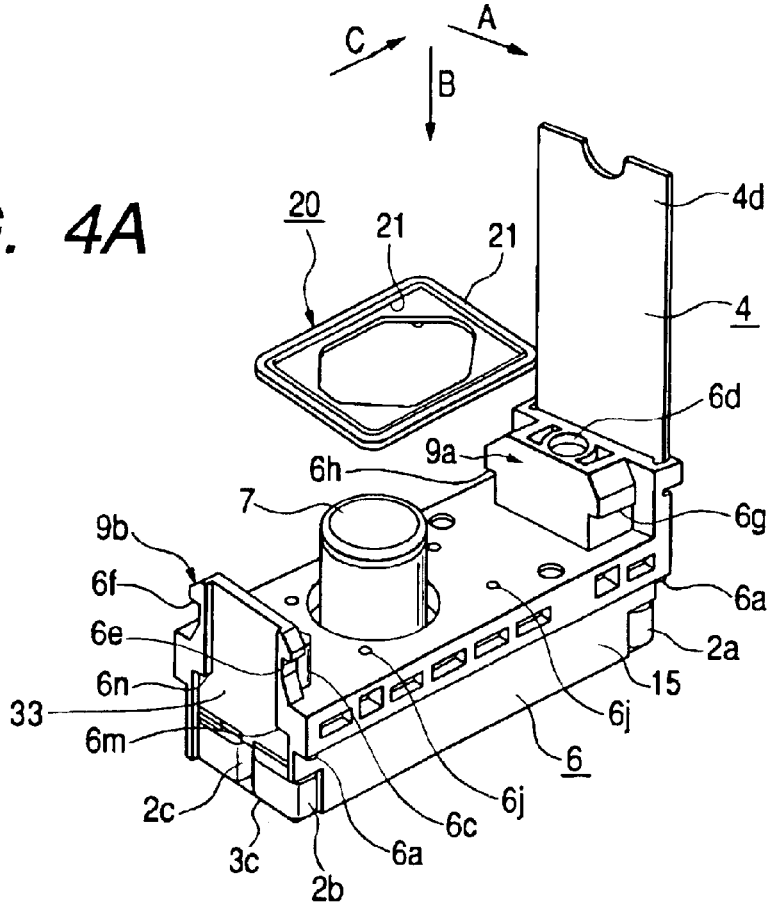
FIG. 4A is a perspective view that shows a flow path formation member, observed from above.
Figure 4B:
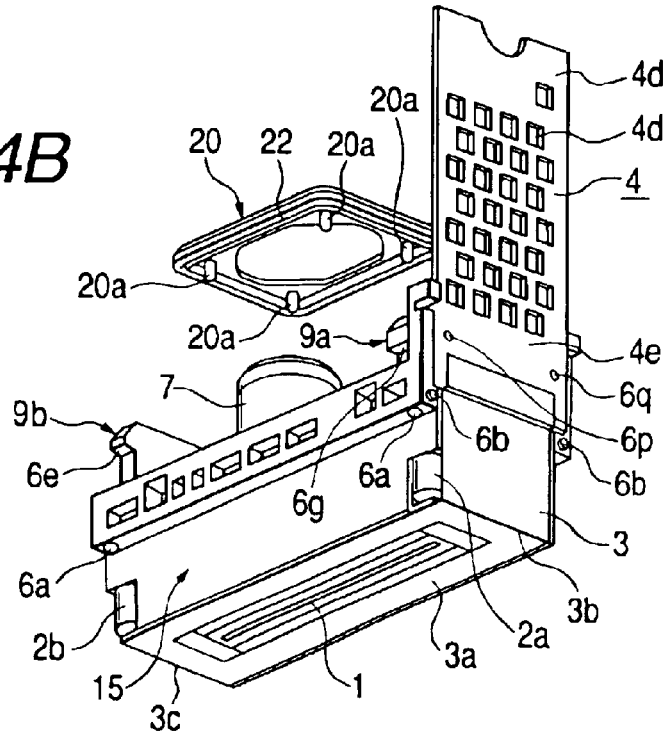
FIG. 4B is a perspective view that shows the flow path formation member, observed from below.
Figure 5:
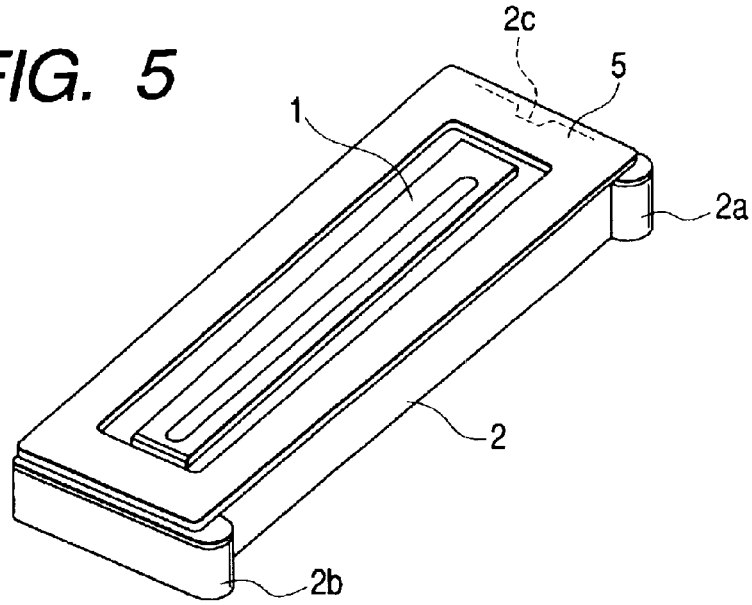
FIG. 5 is a perspective view that shows a recording element base plate and a first plate.
Figure 6:
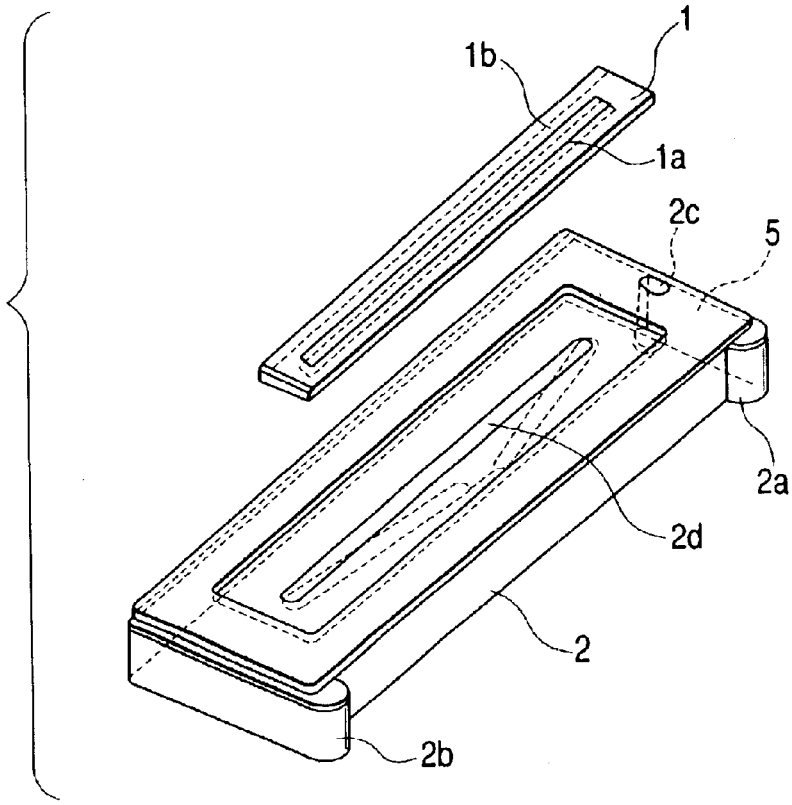
FIG. 6 is an exploded perspective view that shows the recording element base plate and the first plate.
Figure 7:
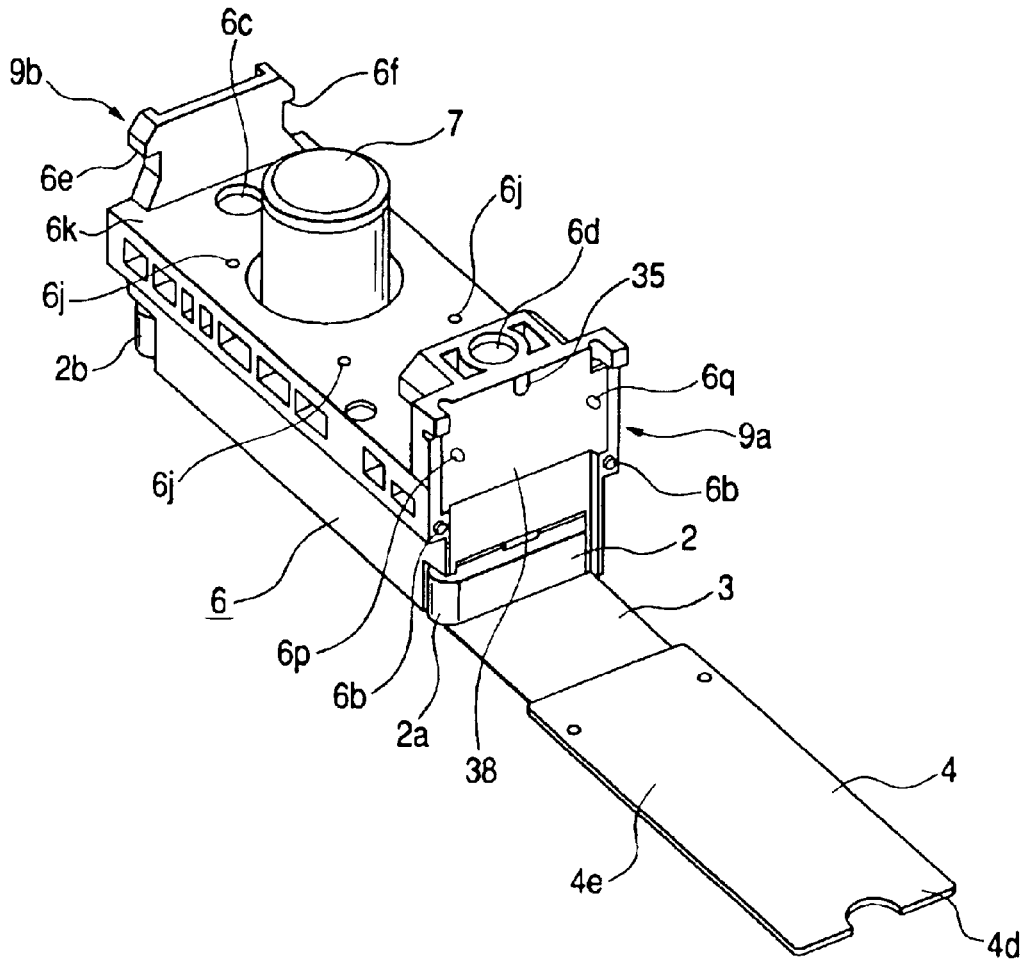
FIG. 7 is a perspective view that shows the flow path formation member without the contact terminal wiring base plate being installed, observed from above.
Figure 8:
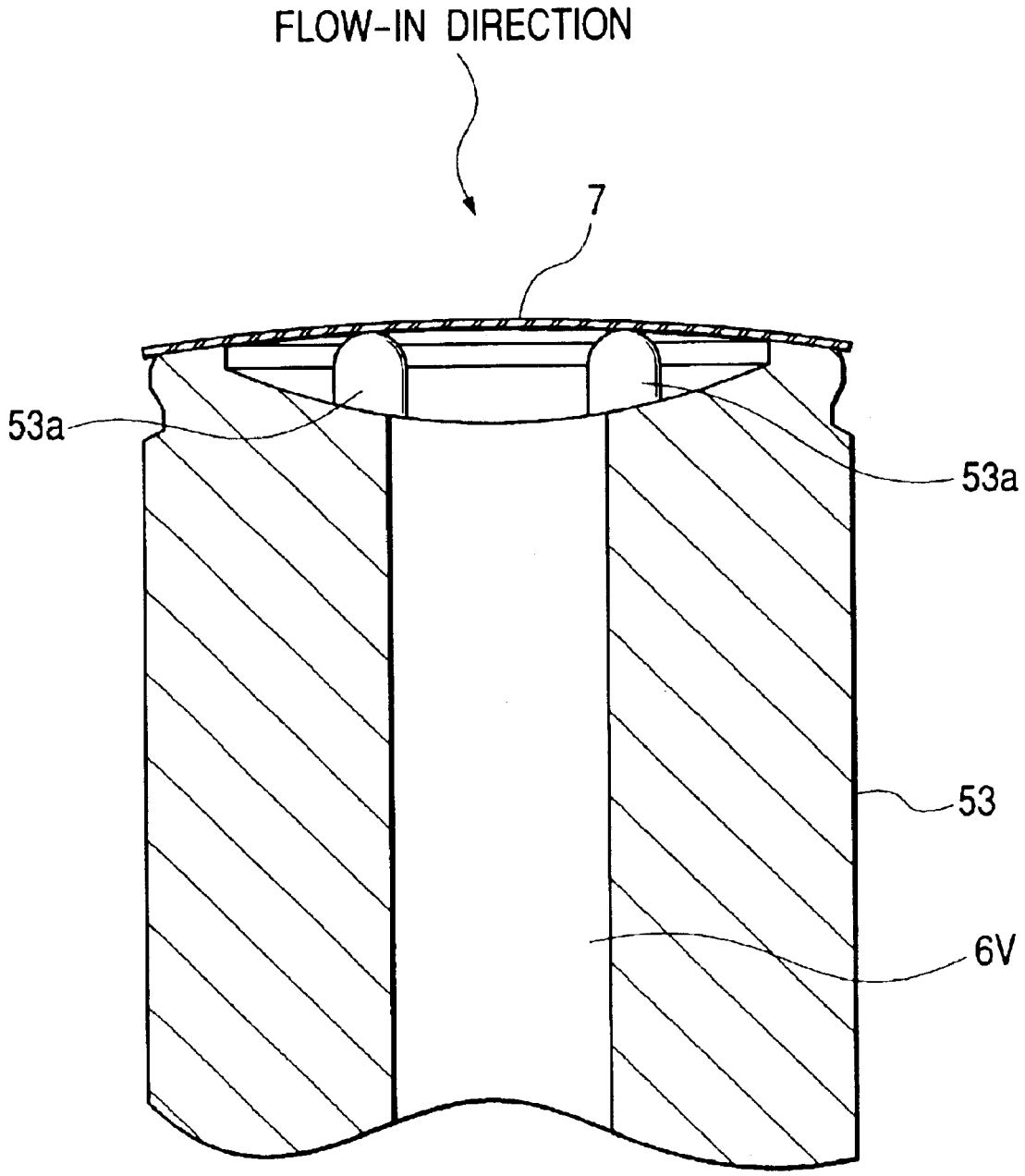
FIG. 8 is a side sectional view that shows the configuration of a porous member.
Figure 9B:
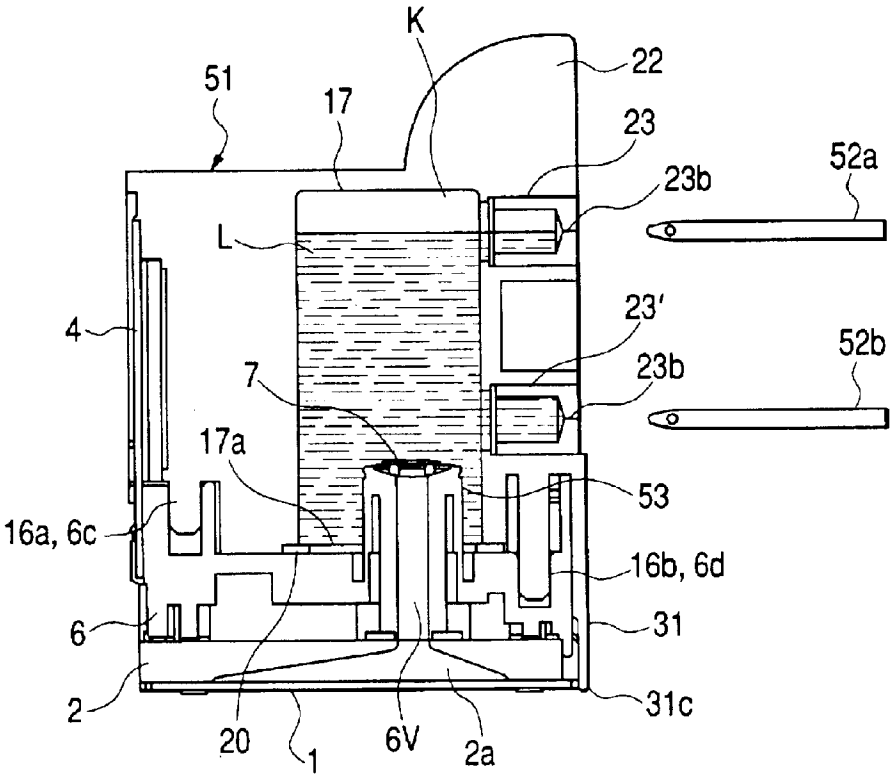
FIGS. 9A and 9B are side sectional views of the liquid discharge recording head of the present invention, which schematically illustrate the arrangement of the porous member and needles, and the flow of supplied recording liquid.
Figure 9A:
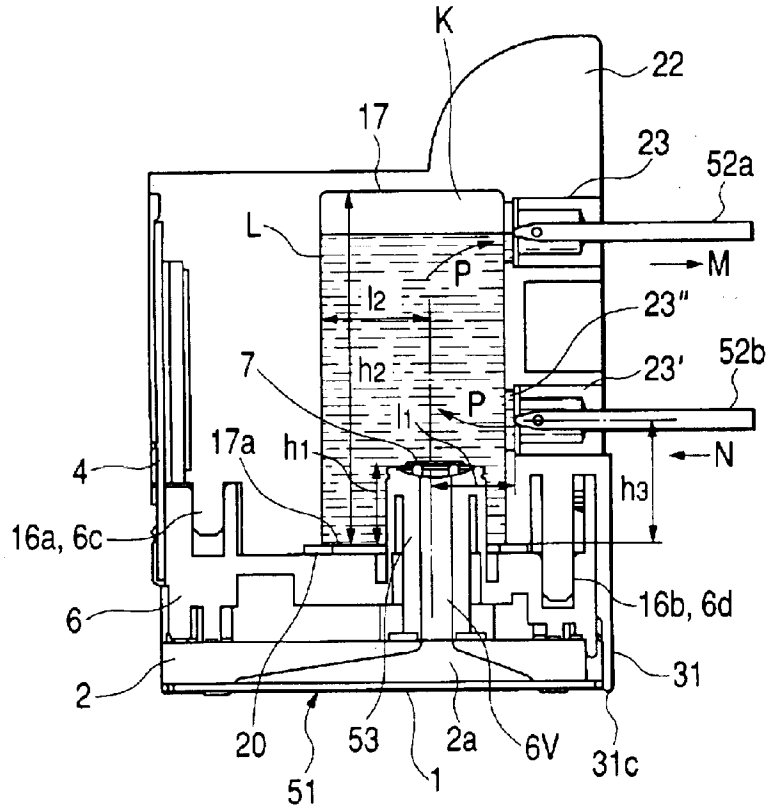
Figure 10:
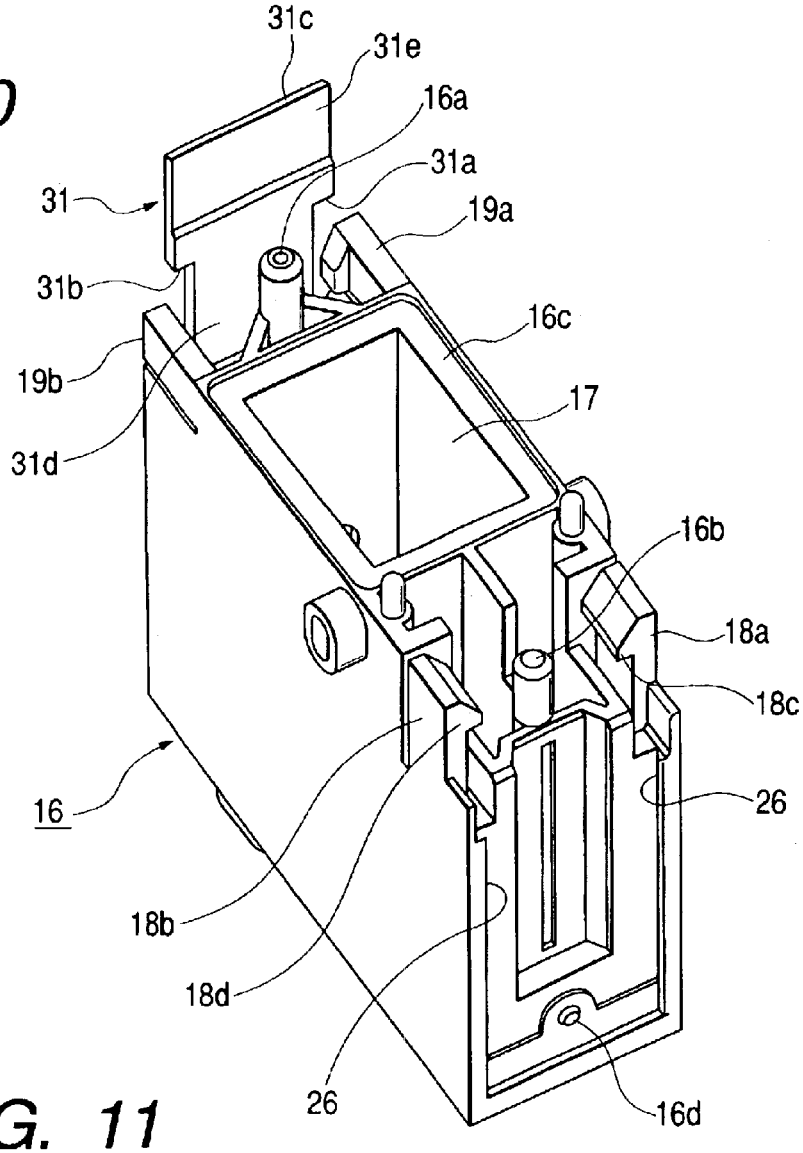
FIG. 10 is a perspective that shows the frame member, observed from below.
Figure 11:
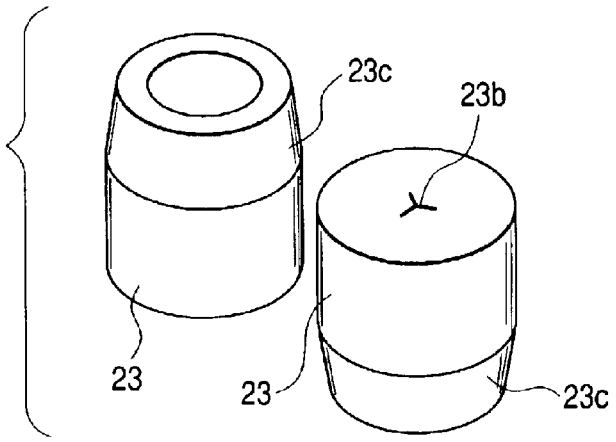
FIG. 11 is a perspective view that shows the outer appearance of the joint rubbers.
Figure 12:
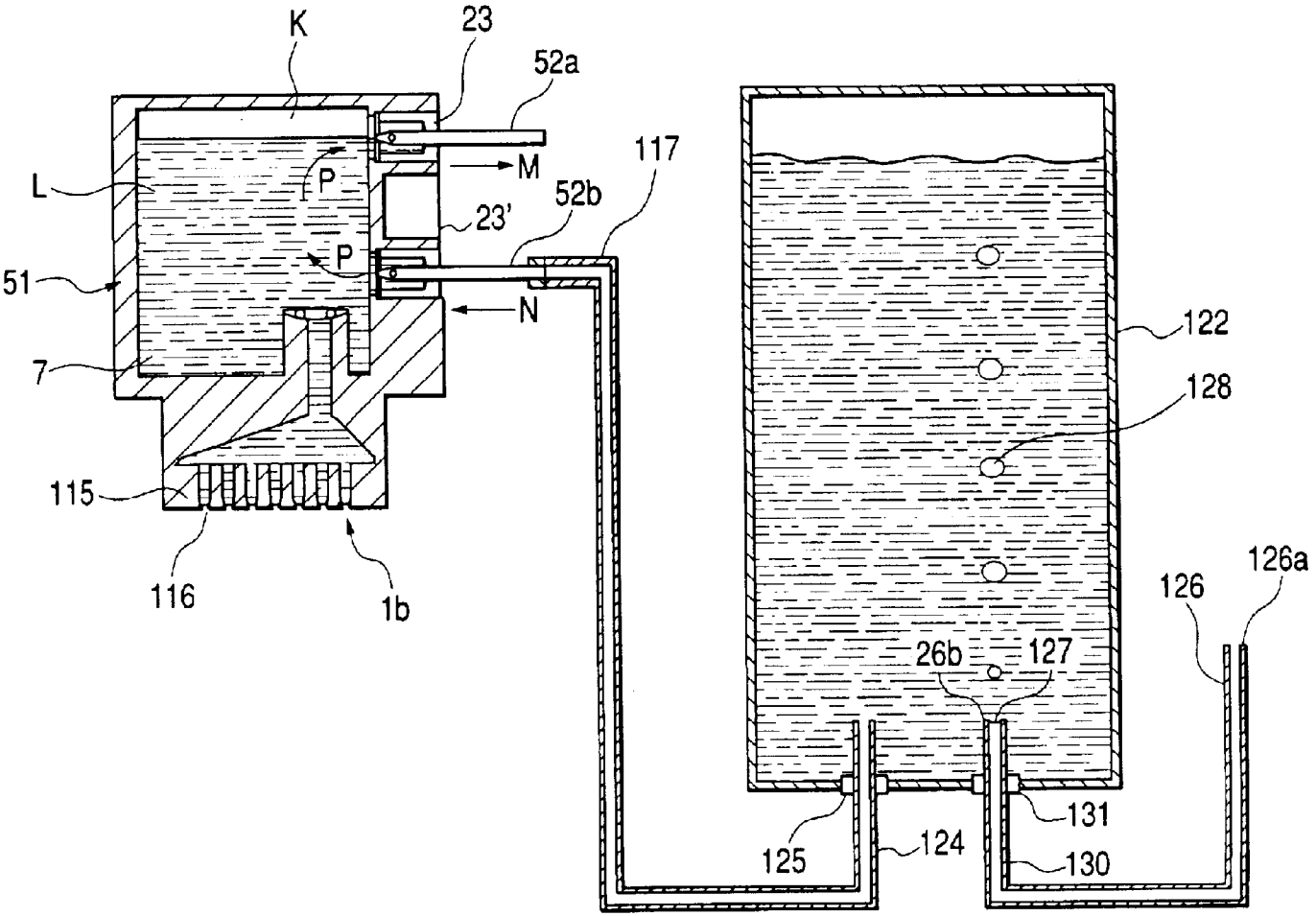
FIG. 12 is a view that schematically shows the supply passage of recording liquid for the liquid discharge recording apparatus in accordance with the present invention.
Figure 13:
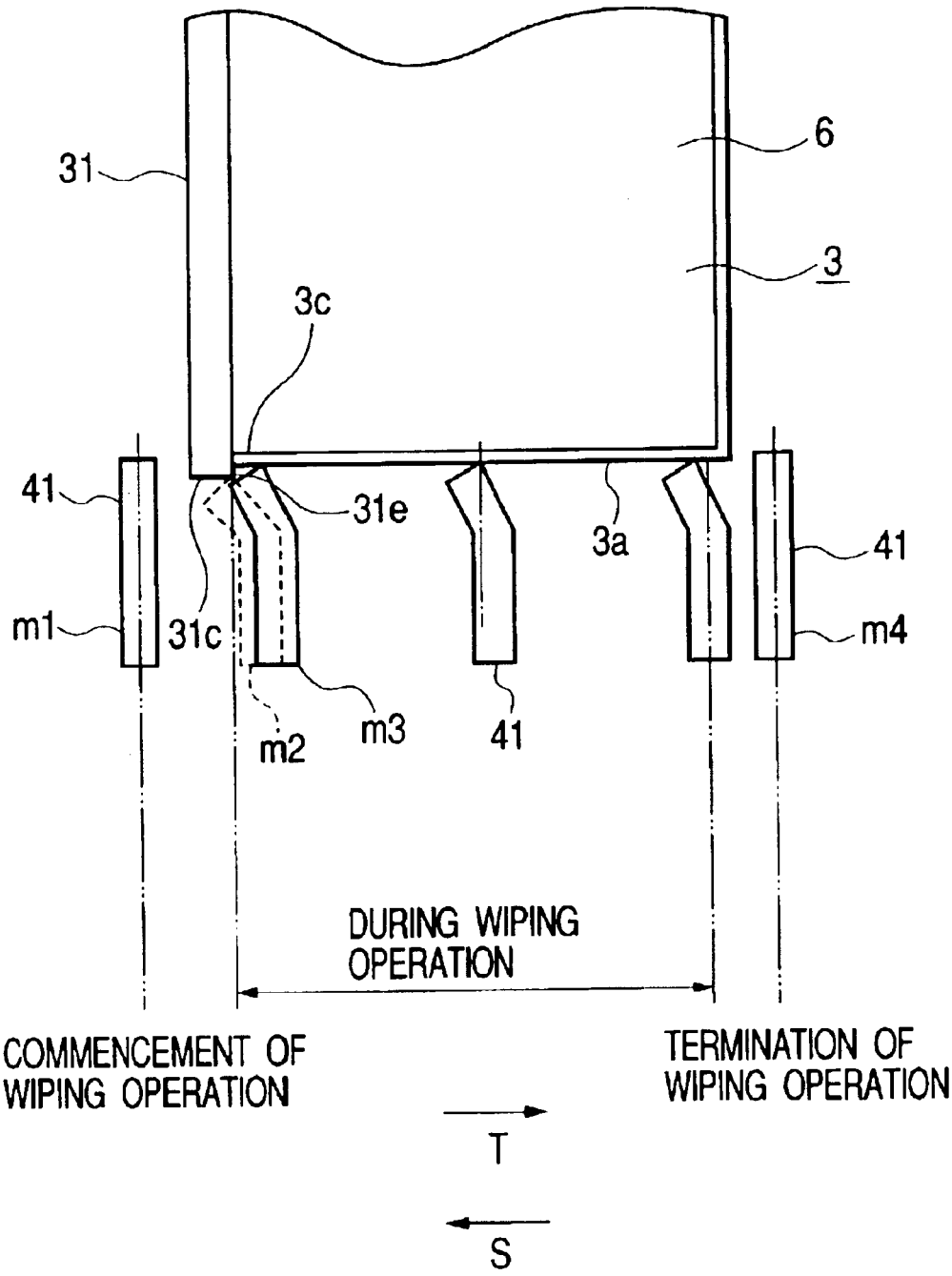
FIG. 13 is a view that illustrates the wiping operation of the blade.
Figure 14:
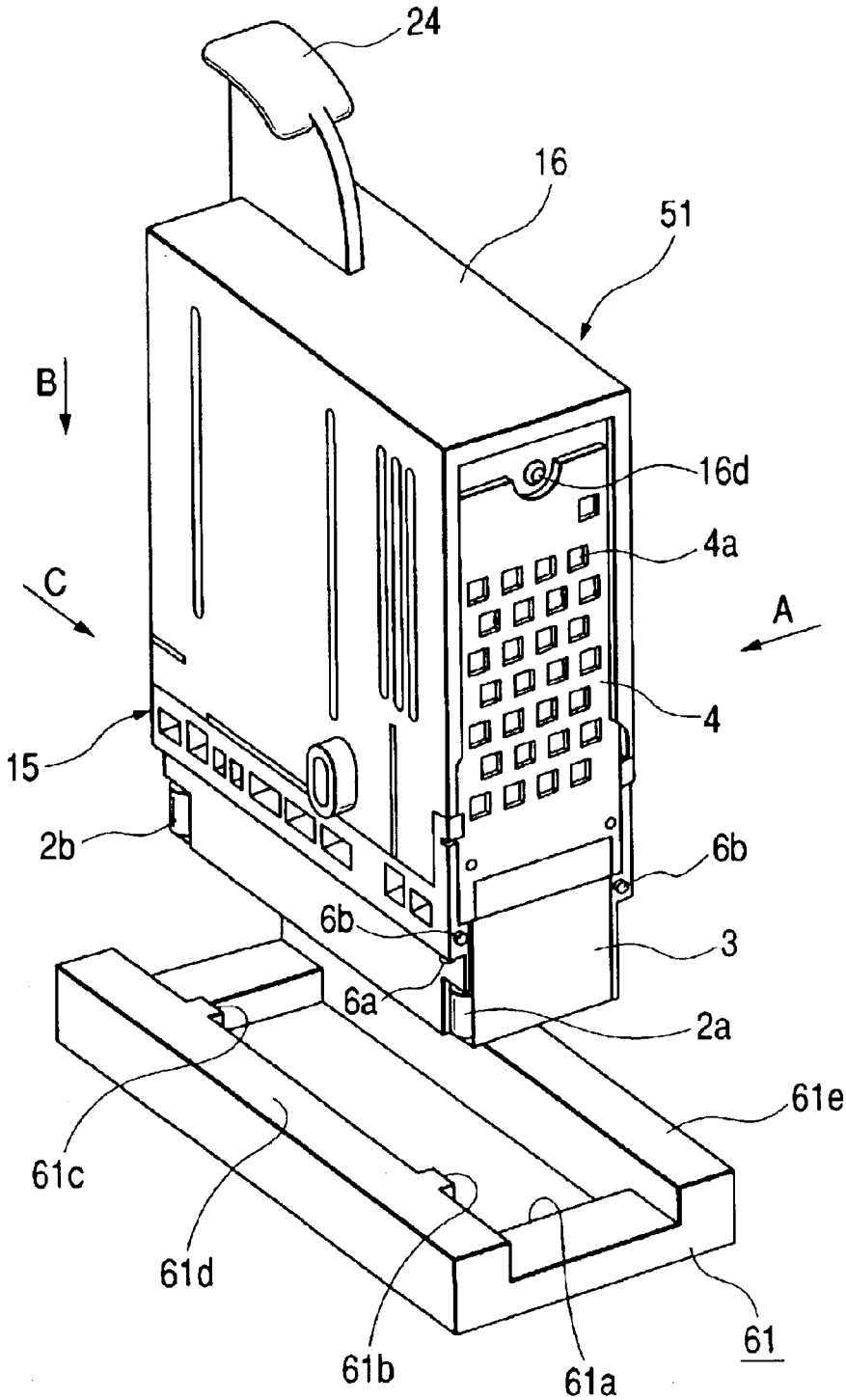
FIG. 14 is a perspective view that shows the outer appearance of the liquid discharge recording head in accordance with the present invention, before it is mounted on the carriage.
Figure 15:
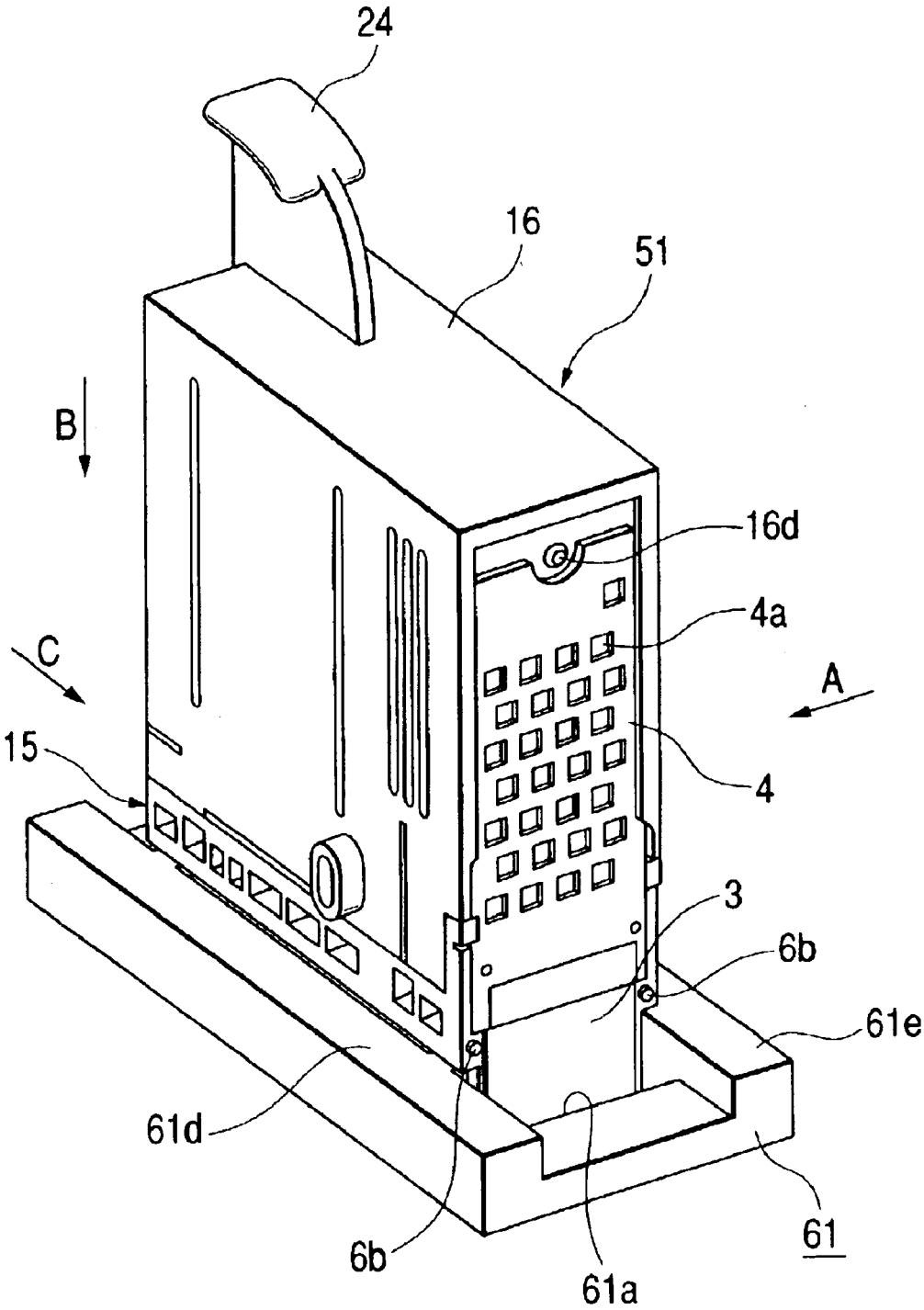
FIG. 15 is a perspective view that shows the outer appearance of the liquid discharge recording head in accordance with the present invention, after it is mounted on the carriage.

FIG. 1 and FIG. 2 are perspective views that illustrate the outer appearance of the liquid discharge recording head embodying the present invention, observed from the side at which a joint rubber is provided for supplying recording liquid and from the side at which the contact terminal wiring base plate is provided, respectively. FIG. 3 is an exploded perspective view of the liquid discharge recording head represented. FIGS. 4A and 4B are exploded perspective views that illustrate the flow path formation member, including the recording unit of the liquid discharge recording head; FIG. 4A is an upper perspective view; and FIG. 4B is a lower perspective view. FIG. 5 and FIG. 6 are partial perspective views that illustrate the outer appearance of the bonding of the recording element base plate; FIG. 5 is a perspective view that shows the bonding condition, and FIG. 6 is a perspective view that shows the exploded condition thereof. FIG. 7 is the lower perspective view that shows the outer appearance of the flow path formation member, including the recording unit of the liquid discharge recording head. FIG. 8 is a side sectional view that shows the sectional shape of the porous member. FIGS. 9A and 9B are side sectional views of the liquid discharge recording head of the present invention, which schematically illustrate the arrangement of the porous member and needles, and the flow of supplied recording liquid; FIG. 9A shows the state in which needles are inserted into the joint rubbers; and FIG. 9B shows the state in which needles are not inserted. Also, FIG. 10 is a perspective that shows the frame member, observed from below. FIG. 11 is a perspective view that shows the outer appearance of the joint rubbers. FIG. 12 is a view that schematically shows the supply passage of recording liquid for the liquid discharge recording apparatus. FIG. 13 is a view that schematically illustrates the wiping operation of the blade. FIG. 14 is a perspective view that shows the outer appearance of the liquid discharge recording head before it is mounted on the carriage. FIG. 15 is a perspective view that shows the outer appearance of the liquid discharge recording head after it is mounted on the carriage.

Hereunder, with reference to the accompanying drawings, the description will be made of the liquid discharge recording head in accordance with the present embodiment.

As shown in FIG. 1, FIG. 2, and FIG. 3, the liquid discharge recording head 51 of the present embodiment is provided with the recording unit 15 that records information on a recording medium by discharging recording liquid, and the frame member 16 (the recording liquid supply supporting member) that holds the recording unit 15, while containing recording liquid to be supplied to the recording unit 15. Although described later in detail, the recording unit 15 is provided, roughly, with a liquid droplet discharge portion that discharges liquid droplets from the nozzle array having discharge ports (nozzles) arranged in line in order to discharge liquid droplets in accordance with recording signals; the wiring sheet, such as a flexible sheet, TAB, which forms electric wiring to receive and transmit recording signals transmitted between the liquid droplet discharge portion and the driving control unit (not shown) provided for the recording apparatus. Roughly, the frame member 16 is structured to function as a recording liquid storing unit, which is provided with the recording liquid storing chamber (common liquid chamber) that contains recording liquid or the like to be supplied to the recording unit 15, and to function as a housing to hold the recording unit 15. Then, the liquid discharge recording head 51 is of the so-called cartridge type in which it is detachably mountable on the carriage provided for the recording apparatus.

At first, with reference to FIG. 1 to FIG. 6, the description will be made of the structure of the recording unit 15 in accordance with one example.

As shown in FIG. 1 to FIG. 6, the recording unit 15 comprises a recording element base plate 1 for discharging recording liquid; a first plate 2 serving as the supporting base plate that supports the recording element base plate 1; a sheet wiring base plate 3 for transmitting recording signals to the recording element base plate 1; a contact terminal wiring base plate 4 with which one end of the sheet wiring base plate 3 is electrically connected to supply recording signals; a second plate 5; a flow path formation member 6 (recording unit portion) provided with a recording liquid supply passage to supply recording liquid to the recording element base plate 1; and a porous member 7 for removing dust particles in the recording liquid.

For the recording element base plate 1, there are formed, by a film formation process, plural recording elements on one side of an Si substrate for discharging recording liquid, and wiring, such as Al, for supplying electric power to each recording element; and by a photolithographic process, plural recording liquid flow paths and plural discharge ports (not shown) corresponding to the recording elements; and also, together therewith, the recording liquid supply port 1*a*, which is open to the backside thereof, for supplying recording liquid to plural recording liquid flow paths communicated with discharge ports.

As shown in FIG. 3, FIG. 5, and FIG. 6, for the first plate 2, cylindrical surface portions 2*a* and 2*b* are provided on the two ends on the side face in the longer side direction, respectively. Also, for the first plate 2, a cylindrical groove 2*c* is provided in the center of the side face in the shorter side direction. Then, with the plane that connects the vertices of the cylindrical surface portions 2*a* and 2*b* at two locations (hereinafter, referred to as a first reference plane), and the cylindrical groove 2*c* as a reference, the relative positions and inclination of the recording-element arrangement surface of the recording element base plate 1 are adjusted, respectively, and after that, the recording element base plate 1 is mounted on the main surface of the first plate 2 for bonding. In this manner, the relative positions of the recording element base plate 1 and the first plate 2 are set in high precision by use of a semiconductor assembling technique. Therefore, assembling is possible with a small amount of inclination from the recording element base plate 1 to the recording-element arrangement surface.

Also, since the first plate 2 is a plate member, it is made possible to carry out manufacturing highly precisely with respect to the plane geometrical precision on the assembling surface of the recording element base plate 1 and the opposite surface thereof, and the parallelism between the assembling surface of the recording base plate 1 and the opposite surface thereof as well. Consequently, although not shown, the joining device (not shown) of the recording element base plate is arranged with a simple structure of a base stand for mounting the first plate 2, and the first plate 2 can be mounted on the base stand in high precision. In this way, the adjustment precision of the recording element base plate 1 is further enhanced with respect to the first plate 2, hence making the precision of the relative inclinations of the first reference plane of the first plate 2 and the recording element base plate 1 better to attempt the enhancement of productivity of the liquid discharge head.

Also, the first reference plane on the side face of the first plate 2 is parallel to the side face of the recording element base plate 1 in the longer side direction. Therefore, as compared with the case where these faces are arranged to be orthogonal, the work observation area of the recording element base plate is made narrower on the device for joining. As a result, the adjustment work on the first plate 2 and the recording element base plate 1 is made easier so as to shorten the time of operation. Furthermore, the mounting space for work is made smaller, hence leading to the low-cost manufacture of the device for joining.

Further, the distance between the vertices of the cylindrical surface portions 2*a* and 2*b* of the first plate 2 is set larger than the length of the arrangement of the recording elements of the recording element base plate 1. Therefore, it is made easier to adjust the inclination of the recording element base plate 1 to the first reference plane by use of the first plate 2 when the adjustment operation is carried out, thus enhancing the adjustment precision for stable production.

Also, as shown in FIG. 3 and FIG. 6, there is formed the recording supply passage 2*d* for the first plate 2 in order to supply recording liquid to the recording element base plate 1.

Also, to the first plate 2, a second plate 5 is bonded and fixed. On the center of the main surface of the second plate 5, an opening portion 5*a* is arranged to avoid interference when the recording element base plate 1 is assembled.

On the other hand, one end of the sheet wiring base plate 3 is bonded to the main surface of the second plate 5 to hold it, and then, is electrically connected with the recording element base plate 1.

Further, the one end of the sheet wiring base plate 3 and the contact terminal wiring base plate 4 are electrically connected by use of ACF (anisotropic conduction film), lead bonding, wire bonding, a connector, or other connecting means, for example.

Here, in accordance with the present embodiment, the structure is arranged to make the sheet wiring base plate 3 and the contact terminal wiring base plate 4 separate members as electric wiring means for supplying recording signals to the recording element base plate 1. However, the structure may be arranged so that the sheet wiring base plate 3 and the contact terminal wiring base plate 4 are formed integrally with one and the same member.

The aforesaid electric wiring means is a series of wiring portions in which the sheet wiring base plate 3 and the contact terminal wiring base plate 4 are electrically connected for use of applying electric signals to the recording element base plate 1 in order to discharge recording liquid. Then, there are formed the electric wiring corresponding to the recording element base plate 1, and the external signal input terminals 4*a* through which electric signals are received from the liquid discharge recording apparatus main body, which are positioned at the end portion of the electric wiring. The contact terminal wiring base plate 4 having these external signal input terminals 4*a* arranged therefor is positioned and fixed to one side face of the flow path formation member 6.

Also, as shown in FIG. 4A and FIG. 4B, the first plate 2 is bonded and fixed to the flow path formation member 6 by use of a bonding agent, screws, or some other bonding means. The first plate 2 and the flow path formation member 6 are bonded to each other, thus enabling the recording liquid passage on the first plate 2 side and the recording liquid passage on the flow path formation member 6 side to communicate with each other.

Also, the flow path formation member 6 is provided with spherical bosses 6*a* and 6*b* protrusively to position the liquid discharge recording head 51 to the carriage to be described later. With the spherical boss 6*a*, the liquid discharge recording head 51 is positioned in the direction indicated by an arrow B in FIG. 4A, and by the spherical boss 6*b*, it is positioned in the direction indicated by an arrow C in FIG. 4A.

Further, as shown in FIG. 8, a porous member 7 is bonded to the flow path formation member 6, and the porous member 7 is bonded by welding, bonding, or other means to the leading end of the cylindrical holder 53 arranged on the side opposite to the bonding portion of the first plate 2. Also, for the cylindrical holder 53, plural receiving pins 53*a* are arranged on the same circumference at equal angular intervals to support the porous member 7. Thus, the surface of the porous member 7 is corrected to be a spherically extruded form in the flow-in direction of liquid, and further, it is made possible to maintain the spherically extruded form even if an external load is received or the inner pressure of the common liquid chamber 17 changes. As described earlier, the porous member 7 is arranged for the purpose of trapping dust particles, such as colorant or dust particles settled from the components of the recording liquid, which adhere to the liquid discharge recording head structural members or an external storing chamber of the recording liquid (not shown), hence preventing the recording liquid flow path on the downstream side of the porous member 7 from being clogged or stained.

Also, for the flow path formation member 6, there are provided fitting extrusions 9*a* and 9*b*, each of which is cut to be formed to engage with the frame member 16, and positioned on either side of the upper face 6*k* in the longer side direction on the side opposite to the side where the first plate 2 is bonded. Also, for the flow path formation member 6, a positioning hole 6*c* is provided in the vicinity of the fitting extrusion 9*b* for positioning it to the frame member 16. Further, for the fitting extrusion 9*a*, a positioning hole 6*d* is provided on the upper end face opposite to the frame member 16 for positioning it to the frame member 16.

Further, on the ends of the fitting extrusion 9*a* of the flow path formation member 6, there are arranged first receiving portions 6*h* and 6*g*, respectively, each of which is cut to be formed to engage with the frame member 16. Also, on both ends of the fitting extrusion 9*b* of the flow path formation member 6, there are provided second receiving portions 6*e* and 6*f*, respectively, each of which is cut to be formed to engage with the frame member 16.

Next, with reference to FIGS. 9A and 9B, and FIG. 10, the description will be made of one example of the frame member 16.

As shown in FIGS. 9A and 9B, and FIG. 10, the frame member 16 is formed of resin material, for example, and functions as a housing of the liquid discharge recording head 51. Inside the frame member 16, the common liquid chamber 17 is arranged to contain recording liquid in a desired amount and to retain the recording liquid L thus contained provisionally or until the complete consumption thereof.

Also, for the frame member 16, there are integrally formed bosses 16*a* and 16*b* on the side facing the flow path formation member 6, respectively, which are inserted into the positioning holes 6*c* and 6*d* of the flow path formation member 6.

Also, for the frame member 16, first snap fittings 18*a* and 18*b*, and second snap fittings 19*a* and 19*b* are formed to be elastically displaceable, on one end facing the flow path formation member 6, which engage relatively with the fitting extrusions 9*a* and 9*b* of the flow path formation member 6, respectively.

Also, as shown in FIG. 1 and FIG. 10, an elongated piece 31 is provided for the frame member 16 to engage with the fitting extrusion 9*b* of the flow path formation member 6, and the elongated piece 31 is integrally formed to be elongated toward the recording unit 15 side on the position on the recording unit 15 side corresponding to the one side face of the first plate 2 in the shorter side direction. The elongated piece 31 extends to the position that covers the end portion 3*c* of the sheet wiring base plate 3 of the recording unit 15, and the leading end 31*c* is slightly protruded from the face plane 3*a* of the recording unit 15 in the direction substantially orthogonal to the face plane 3*a* (see, for example, FIG. 13).

Also, the elongated piece 31 is a flat plate almost in the shape of the letter T, and provided with an elastically displaceable portion 31*d* on the base end side, which is made elastically displaceable in the thickness-wise direction. Further, for the elongated piece 31, there are formed on both ends of the first plate 2 in the shorter side direction, which are parallel in the widthwise direction, hooks 31*a* and 31*b*, each of which is cut to be formed to engage with the fitting extrusion 9*b* of the flow path formation member 6. Also, for the fitting extrusion 9*b* of the flow path formation member 6, an engaging recess 33 (see FIG. 4A) is arranged to engage with the elongated piece 31 on the side end facing the outside. On the sidewall of the engaging recess 33, there are formed the third receiving portions 6*m* and 6*n*, with which the hooks 31*a* and 31*b* of the elongated pieces 31 are arranged to engage, respectively.

Further, for the frame member 16, the handle 24, which is integrally formed to hold the liquid discharge recording head 51, is provided on the outer circumference on the side opposite to the side where the recording unit 15 is arranged.

Then, when the bosses 16*a* and 16*b* of the frame member 16 are inserted into the position holes 6*c* and 6*d* of the flow path formation member 6, the frame member is positioned on the flow path formation member 6. Thus, the first snap fittings 18*a* and 18*b* and the second snap fittings 19*a* and 19*b* of the frame member 16 engage with the first receiving portions 6*g* and 6*h* and the second receiving portions 6*e* and 6*f* of the fitting extrusions 9*a* and 9*b* of the flow path formation member 6, and likewise, the elongated piece 31 of the frame member 16 engages with the third receiving portions 6*m* and 6*n*. In this manner, the frame member 16 is completely bonded and fixed to the flow path formation member 6.

As described above, the hooks 31*a* and 31*b* are provided for the elongated piece 31 to arrange the structure so that the hooks engage with the third receiving portions 6*m* and 6*n* of the flow path formation member 6. Therefore, even if an external force is exerted on the elongated piece 31 in the direction to push it to be away from the sheet wiring base plate 3, the elastically displaceable portion 31*d* of the elongated piece 31 is able to prevent the occurrence of bending deformation in the direction to release such engagement by means of the frictional resistance resulting from the condition of the engagement between the hooks 31*a* and 31*b* and the third receiving portions 6*m* and 6*n*.

Consequently, with the arrangement of the elongated piece 31 for the frame member 16, the length of the elastically displaceable portion 31*d* of the elongated piece 31 is made larger, and the bending rigidity of the elastically displaceable portion 31*d*. However, the structure is such that even if the thickness of the elastically displaceable portion 31 d is made smaller, the portions in engagement are not easily released, thus making it possible to attempt downsizing of the liquid discharge head as a whole.

In this respect, the inner wall face 31*e* (see, for example, FIG. 13) of the elongated piece 31 is arranged in the vicinity of the end portion 3*c* of the sheet wiring base plate 3 in the state that the frame member 16 and the flow path formation member 6 are bonded. On the other hand, the leading end portion 31*c* of the elongated piece 31 is arranged to protrude slightly from the face plane 3*a* of the sheet wiring base plate 3 in the recording liquid discharge direction.

Now, if the elongated piece 31 is provided on the side where the flow path formation member 6 is arranged, the elongated piece 31 becomes an obstacle when the sheet wiring base plate 3 is pushed to the flow path formation member 6 side in the bonding process of the sheet wiring base plate 3. In this case, therefore, it is necessary to bond the sheet wiring base plate 3 eventually onto the second plate 5 before bonding the flow path formation member 6. Thus, the structure in which the elongated piece 31 is provided on the side where the flow path formation member 6 is arranged affects the freedom of the setting processes, and productivity is undesirably deteriorated.

Furthermore, the leading end portion 31*c* of the elongated piece 31 protrudes from the face plane 3*a*. For example, therefore, if a recording sheet that has a large curl should pass or a paper jam process is needed for the recording apparatus, among some other events, the leading end portion 31*c* of the elongated piece 31 abuts against the recording sheet even when the recording sheet would tend to be in contact with the discharge ports. In this manner, any contact between a recording sheet and the discharge ports can be prevented. Thus, with the elongated piece 31, it is possible to prevent any damage that may be caused by a recording sheet to the circumference of the discharge ports and the face plane 3*a*, and also, to avoid the occurrence of any drawback that may degrade the quality of images recorded on the recording sheet.

The rail-like groove 26 (see FIG. 2), which is formed for the frame member 16, holds the contact terminal wiring base plate 4 exactly when the frame member 16 and the flow path formation member 6 are bonded. Here, the leading end portion 4*d* of the contact terminal wiring base plate 4 enters the rail-like groove 26 to be fitted into the pre-determined position. In other words, the lower end portion 4*e* of the contact terminal wiring base plate 4 is held by the flow path formation member 6, and the leading end portion 4*d* of the contact terminal wiring base plate 4 is held by the rail-like groove 26 of the frame member 16.

As described above, unlike the structure in which the contact terminal wiring base plate 4 is fixed to the flow path formation member 6 by hot-clamping, there is no need for the provision of any holes on the contact terminal wiring base plate 4 for use of hot-clamping, which makes it possible to make the width of the contact terminal wiring base plate 4 smaller. Thus, the entire width of the liquid discharge head can be made more compact.

Also, the structure is such that when the flow path formation member 6 is assembled with the frame member 16, the leading end portion 4*d* of the contact terminal wiring base plate 4 is inserted into the rail-like groove 26. This makes it possible to curtail the steps of manufacturing process needed for fixing the contact terminal wiring base plate 4, thus attempting the enhancement of productivity. Moreover, the contact terminal wiring base plate 4 can be removed easily to make the dismantling operation of the liquid discharge recording head 51 easier. Therefore, this structure is excellent, too, in terms of the recycling capability.

Also, the contact terminal wiring base plate 4 is held in such a manner that the flow path formation member 6 and the frame member 16 are separated. As a result, unlike the conventional structure, there is no need for the provision of any space that may enable the flow path formation member 6 to receive the entire area of the contact terminal wiring base plate 4. The flow path formation member 6 can be formed efficiently to make it more compact accordingly.

Also, the liquid discharge recording head 51 is provided with a sealing member 20 to airtightly close the connecting part of the recording flow passage between the frame member 16 and the flow path formation member 6. The sealing member 20 is formed of rubber, elastomer, or other elastic material in the form of a frame, for example, and as shown in FIG. 4A and FIG. 4B, the upper rib 21 and lower rib 22 are integrally formed to extrude along the outer circumference on the upper face opposite to the frame member 16, and the lower face opposite to the flow path formation member 6, respectively.

Also, for the sealing member 20, a positioning boss 20*a*, which engages with the upper face 6*k* to be positioned, is arranged for each of the comer portions on the lower face opposite to the upper face 6*k* of the flow path formation member 6, respectively. Also, on the upper face 6*k* of the flow path formation member 6, a positioning hole 6*j*, with which each positioning boss 20*a* of the sealing member 20 engages, is arranged, respectively, along the outer circumference of the porous member 7.

Then, after each positioning boss 20*a* is inserted into each positioning hole 6*j* of the flow path formation member 6 for positioning, the frame member 16 and the flow path formation member 6 are assembled. Thus, the sealing member 20 closes the inside of the common liquid chamber 17 completely, because the upper rib 21 on the upper face side and the lower rib 22 on the lower face side are compressed by the nipping pressure exerted by the lower face 16*c* (see FIG. 10) of the frame member 16 and the upper face 6*k* of the flow path formation member 6.

As described above, when the frame member 16 and the flow path formation member 6 are connected, the porous member 7 enters the common liquid chamber 17. As a result, recording liquid L in the common liquid chamber is supplied from the porous member 7 to the nozzle portion of the recording element base plate 1 through the recording liquid supply port 1 a of the recording element base plate 1 by way of the flow path 6*v* (see FIG. 9) of the flow path formation member 6 and the recording liquid supply path 2*d* of the first plate 2.

In this respect, the porous member 7 is installed at a position higher than the bottom face 17*a* (see FIGS. 9A and 9B) of the common liquid chamber 17.

Also, the handle 24 provided for the ceiling face of the frame member 16 functions as the handhold when the liquid discharge recording head 51 is attached to or detached from the carriage 61 provided for the recording apparatus.

Further, for the frame member 16, there are provided an upper joint rubber 23 serving as the exhaust portion for exhausting the air K inside the common liquid chamber 17, and a lower joint rubber 23' serving as the supply portion of recording liquid in order to supply recording liquid to the common liquid chamber 17. As shown in FIG. 11 (the upper joint rubber 23 and the lower joint rubber 23' having the same structure, FIG. 11 shows only the upper joint rubber 23), on the center of the end face of the upper joint rubber 23 and that of the lower joint rubber 23', respectively, a cracked hole 23*b* is arranged as a Y-shaped slit. Then, as shown in FIG. 1, each of the joint rubbers 23 and 23' is pressed into a respective cylindrical hole 16*d* of the frame member 16, the inner dimension of which is made smaller than the outer dimension of each of the joint rubbers 23 and 23'. Also, each leading portion 23*c* of the joint rubbers 23 and 23', which is pressed into the frame member 16, is tapered with a diameter decreasing toward the leading end, thus securing the excellent insertion capability in the cylindrical hole 16*d*.

As described above, with the cracked hole 23*b* formed for each of the joint rubbers 23 and 23', each leading end of needles 52*a* and 52*b* breaks the cracked hole 23*b* as shown in FIG. 9A when the upper needle 52*a*, which exhausts the air K in the common liquid chamber 17 of the recording liquid supply mechanism (not shown) of the recording apparatus, and the lower needle 52*b*, for supplying recording liquid, are inserted into each of them, respectively. In this manner, the insertion into the common liquid chamber 17 of the frame member 16 is effectuated smoothly. Also, as shown in FIG. 9B, the cracked hole 23*b* is closed by receiving the compression load from the outer circumference of each of the joint rubbers 23 and 23' when each of the needles 52*a* and 52*b* are not inserted. Therefore, the inside of the common liquid chamber 17 can be conditioned to be airtight. In this way, each of the joint rubbers 23 and 23' is made workable by being able to switch between the recording liquid supply condition in which recording liquid can be supplied from the outside to the common liquid chamber 17 and the condition in which there is no supply of recording liquid from the outside to the common liquid chamber 17.

The joint rubbers 23 and 23' are arranged on the two locations, upper and lower, respectively. The lower joint rubber 23' is the supply passage for supplying recording liquid L from the recording liquid storing tank 122 (see FIG. 12) arranged for the recording apparatus main body, and recording liquid L is supplied into the common liquid chamber 17 through the lower needle 52*b* in the direction indicated by the arrow N.

On the other hand, the upper joint rubber 23 is the suction air passage for negatively pressurizing the inside of the common liquid chamber 17 as described above by releasing the air K accumulated inside the common liquid chamber 17 to the outside of the common liquid chamber 17. Therefore, with suction air driving means (not shown), such as a pump, the air K inside the common liquid chamber 17 is exhausted from the common liquid chamber 17 to the outside through the upper needle 52*a* in the direction indicated by the arrow M, thus controlling the negative pressure inside the common liquid chamber 17. In other words, by increasing the negative pressure inside the common liquid chamber 17, it is possible to control the replenishment of recording liquid L in the common liquid chamber 17.

Further, the upper needle 52*a* and the lower needle 52*b* are made electrically conductive, and when the height of liquid surface of recording liquid L in the common liquid chamber is raised to enable both the upper needle 52*a* and the lower needle 52*b* to be in contact with recording liquid L, the upper needle 52*a* and the lower needle 52*b* are electrically connected through recording liquid L. As a result, the full-tank condition of the liquid surface of recording liquid L can be detected.

As described above, in the mode of the liquid discharge recording head in which recording liquid L is supplied from the recording liquid storing tank 122, recording liquid L inside the common liquid chamber 17 flows in the direction from down to up as indicated by the arrows P in FIG. 9A and FIG. 12 when recording liquid is supplied.

Therefore, recording liquid L inside the common liquid chamber 17 is agitated along the flow of recording liquid L that moves, and flow occurs for recording liquid even in the vicinity of the surface of the porous member 7 eventually.

As described earlier, the surface of the porous member 7 is in the spherically extruded form, which is made smoothly convex. This arrangement is made so as not to disturb the flow of recording liquid L, which is in contact with the surface of the porous member 7, and it is also made possible to enable the flow of recording liquid to be in contact with the entire area of the surface of the porous member 7 efficiently.

Further, on the circumference of the porous member 7, the flow of recording liquid L is controlled to continue as much as possible without resistance. For such purpose, countermeasures are taken such as to make the holder 53 for holding the porous member 7 in cylindrical form, and to arrange the porous member 7 higher than the bottom face 17*a* of the common liquid chamber 17 (at the height h1 in FIG. 9A), among some others.

As a result, when agitated, colorant, dust particles, and other matter accumulated on the surface of the porous member 7 are transferred by the flow of recording liquid to part from the surface of the porous member 7, thus floating again in the recording liquid L or dropping off toward the bottom face 17*a* of the common liquid chamber 17. Thus, colorant and dust particles floating in recording liquid L that have settled on the surface of the porous member 7 sooner or later or settle down on the bottom face 17*a* of the common liquid chamber 17. Here, the quantity of particles dropping off to the bottom face 17*a* becomes larger inevitably, because the bottom face 17*a* has the larger area ratio.

It is anticipated that matter that has settled on the surface of the porous member 7 is again transferred for removal when the next agitation takes place.

On the other hand, matter that has dropped off to the bottom face 17*a* of the common liquid chamber 17 is caused to ultimately remain on that area even if agitation is repeatedly performed, because the bottom face 17*a* is away from the area where flow is induced, and also, because it is difficult for the particles to float again to join the flow of recording liquid, due to the existence of such obstacles as the cylindrical holder 53, and a larger resistance that acts on the flow of recording liquid L, which collides with the bottom face 17*a*.

As described above, with the agitation occurring inside the common liquid chamber 17 when recording liquid L is supplied, recording liquid L flows smoothly in contact with the surface of the porous member 7, thus preventing colorant and dust particles from stagnating on the surface of the porous member 7 so as to remain thereon.

In this respect, if the porous member 7 were formed with a flat face or in a recessed form, resistance would be generated when colorant and dust particles are transferred thereto, and colorant and dust particles could not ride the flow of recording liquid L at the time of agitation, thus impeding their ultimate removal from the surface of the porous member.

Under the circumstances described above, it becomes an effective means for the active transfer of colorant and dust particles on the surface of the porous member 7 that the porous member 7 is provided at an area where the recording liquid L flows with good force.

Now, in accordance with the present embodiment, the distance 11 from the center of the cylindrical holder 53 to the end portion 23" of the lower joint rubber 23' is made smaller than the distance 12 from the center of the cylindrical holder 53 to the surface of the common liquid chamber 17 opposite to the joint rubbers 23 and 23', in order to enable the flow of recording liquid supplied from the lower needle 52*b* to be efficiently in contact with the entire area of the surface of the porous member 7. In other words, the porous member 7 is arranged closely to the lower joint rubber 23'.

Also, in order to activate agitation, the bottom face 17*a* of the common liquid chamber 17 is made narrower, while the arrangement is made to enable the inner height h2 of the common liquid chamber 17 to be larger. Further, as a method other than the one described in the present embodiment, it may be effective to make arrangement so that the height h1 of the porous member 7 is set equal to or greater than the height h3 of the lower joint rubber23'.

Next, in conjunction with FIG. 12 that schematically shows the structural outline of the recording apparatus that includes the liquid supply device embodying the present invention, the detailed description will be made of the process of supplying liquid from the recording liquid storing tank to the common liquid chamber.

The recording liquid supply device is directed vertically downward, and provided with the recording liquid storing tank 122 that contains recording liquid; the recording liquid supply tube 117 constituting a first pipe-type connector through which recording liquid is supplied from the recording liquid storing tank 122 to the liquid discharge recording head 51; and the air releasing tube 126 serving as a second pipe-type connector through which the air is induced into the recording liquid storing tank 122.

The recording liquid supply tube 117 contains the pipe-type needle portion 124, which is formed of stainless steel or the like. The needle portion 124 penetrates the rubber plug 125 covering the hole provided for the bottom face of the recording liquid storing tank 122, which can be inserted into the recording storing tank 122. Likewise, the air releasing tube 126 contains the pipe-type needle portion 130, which is formed of stainless steel or the like. The needle portion 130 penetrates the rubber plug 131 covering the hole provided for the bottom face of the recording liquid storing tank 122, which can be inserted into the recording storing tank 122.

The holes thus provided for the bottom face of the recording liquid storing tank 122 are released to create an injection inlet when recording liquid is to be injected into the recording liquid storing tank 122 for future use, and after the injection of recording liquid, each of the holes is plugged by the rubber plugs 125 and 131, respectively. As shown in FIG. 12, when installed on the recording apparatus main body, the needle portions 124 and 130 penetrate the rubber plugs 125 and 131, respectively, thus being inserted into the recording liquid storing tank 122. Then, the recording liquid storing tank 122 and the liquid discharge recording head 51 are communicated through the recording liquid supply tube 117 that contains the needle portion 124 (the first connector), while the air inside the recording liquid storing tank 122 is released through the air releasing tube 126 that contains the needle portion 130 (the second connector).

The liquid discharge recording head 51 is installed on the recording apparatus main body with the recording liquid discharge port surface 1*b* of the recording element base plate 1 having the discharge ports formed therefor downward.

The inside of the recording liquid supply tube 117 that contains the needle 124 is filled with recording liquid over its entire length. The common liquid chamber 17 is not filled with recording liquid up to the full capacity thereof. There remains a portion where the air K is accumulated. Also, using a valve or the like (not shown) the needle 52*a* side is closed after it has been used for the suction of recording liquid to fill the inside of the liquid discharge recording head 51. Therefore, recording liquid L is not allowed to leak out.

For the nozzle 115 communicated with each discharge port, a meniscus 116 of recording liquid is formed. With the surface tension of the meniscus 116, recording liquid is retained in the vicinity of the discharge port so as not to drop off.

Next, the description will be made, further in detail, of the bonding condition of the flow path formation member 6 of the recording unit 15 and the frame member 16.

The boss 16*a* of the frame member 16 is inserted into the positioning hole 6*c* of the flow path formation member 6. The boss 16*b* of the frame member 16 is inserted into the positioning hole 6*d* of the flow path formation 6. The first snap fittings 18*a* and 18*b* of the frame member 16 engage with the first receiving portions 6*g* and 6*h* of the flow path formation member 6. The second snap fittings 19*a* and 19*b* of the frame member 16 engage with the second receiving portions 6*e* and 6*f* of the flow path formation member 6. The hooks 31*a* and 31*b* of the elongated piece 31 of the frame member 16 engage with the third receiving portions 6*m* and 6*n* of the flow path formation member 6. Further, the frame member 16 and the flow path formation member 6 nip the sealing member 20 between the opposite faces thereof to bond it under pressure. In this manner, each of the recording liquid flow paths of the frame member 16 and flow path formation member 6 is airtightly closed to enable both of them to be communicated and fixed completely.

Therefore, as compared with the mode in which the recording unit 15 and the frame member 16 are bonded by the use of screws, bonding agent, or the like, or the mode in which bonding portions of both of them are airtightly closed through sealant or the like, the liquid discharge recording head 51 of the present embodiment makes it easier to assemble the recording unit 15 and the frame member 16 with a structure suitable for recycling performance, hence making the manufacture of the liquid discharge recording head 51 possible at lower costs.

Also, the first snap fittings 18*a* and 18*b*, and the second snap fittings 19*a* and 19*b* are each provided with a pair of fitting nails that face each other in the positions facing the first receiving portions 6*g* and 6*h*, and the second receiving portions 6*e* and 6*f* in the direction of being hooked, respectively. Therefore, the hooking conditions of the fitting nails are held strongly.

Further, the elastically displaceable portions of the first snap fittings 18*a* and 18*b* in the longitudinal direction are formed in agreement with the bonding direction in which the frame member 16 and the flow path formation member 6 are bonded. Also, the elastically displaceable portions of the second snap fittings 19*a* and 19*b* in the longitudinal direction are formed in the direction substantially orthogonal to the bonding direction in which the frame member 16 and the flow path formation member 6 are bonded. In other words, the elastically displaceable portions of the first snap fittings 18*a* and 18*b* and the second snap fittings 19*a* and 19*b* are formed in elastically displaceable directions orthogonal to each other when the frame member 16 and the flow path formation member 6 are bonded.

In this way, the tensile stress acts in the longitudinal direction of the elastically displaceable portions of the first snap fittings 18*a* and 18*b* if any shock is given in the direction (indicated by the arrow $\alpha$ in FIG. 1) in which the bonding condition of the frame member 16 and the flow path formation member 6 is released due to unexpected dropping of the liquid discharge recording head 51 or the like. However, with the rigidity provided for the first snap fittings 18*a* and 18*b*, which sufficiently withstands such tensile stress, there is no possibility that the bonding condition between the first snap fittings 18*a* and 18*b* and the first receiving portions 6*g* and 6*h* are released due to the load of shocks that may act in that direction.

Also, the frame member 16 and the flow path formation member 6 are bonded with the sealing member 20, which is nipped under compression, and the repulsion of the sealing member 20 always acts in the direction in which the frame member 16 and the flow path formation member 6 separate from each other. The elastically displaceable portions of the first snap fittings 18*a* and 18*b* are provided with the tensile strength that sufficiently withstands such repulsion of the sealing member 20. Also, likewise, the elastically displaceable portion 31*d* of the elongated piece 31 is provided with the tensile strength that can withstand the repulsion of the sealing member 20.

Further, the hook faces of the first snap fittings 18*a* and 18*b*, and the first receiving portions 6*g* and 6*h* are in contact substantially horizontally (in parallel) for the engagement thereof. Therefore, the frame member 16 and the flow path formation member 6 are bonded with highly precise positioning, which is effectuated by the connection of these two members.

On the other hand, at the location where the second snap fittings 19*a* and 19*b* and the second receiving portions 6*e* and 6*f* engage with each other, bending stress acts on the elastically displaceable portions of the second snap fittings 19*a* and 19*b* if any shocks are received in the direction opposing the bonding of the frame member 16 and the flow path formation member 6. Here, the rigidity of the second snap fittings 19*a* and 19*b* is comparatively small against such bending stress. Therefore, although there is no possibility that the bonding condition of the second snap fittings is released, bending deformation occurs eventually if a large load is received.

Moreover, as described above, the repulsion of the sealing member 20 always acts on the connecting portion of the frame member 16 and the flow path formation member 6. There is a fear that displacement will take place due to such bending deformation, which causes the frame member 16 and the flow path formation member 6 to move in the direction in which these members are separated. This eventually leads to the deterioration of positioning precision for the frame member 16 and the flow path formation member 6.

In other words, against such repulsion brought about by the sealing member 20 of the kind, it is made possible for the first snap fittings 18*a* and 18*b* and the elongated piece 31 to secure a larger resistance to the load than the load resistance that may be provided by the second snap fittings 19*a* and 19*b*. Therefore, against the repulsive load of the sealing member 20, support is mainly provided by the engaging portions 18*c* and 18*d* of the first snap fittings 18*a* and 18*b* and the hooks 31*a* and 31*b* of the elongated piece 31, ultimately.

Thus, the elongated piece 31, which is positioned and arranged near the second snap fittings 19*a* and 19*b* reinforces the bonding strength of the second snap fittings 19*a* and 19*b* in the direction in which the recording unit 15 and the frame member 16 are separable.

Next, the description will be made of the case where shocks are received in the hook displacement direction (indicated by an arrow β in FIG. 1) of the first snap fittings 18*a* and 18*b* and the second snap fittings 19*a* and 19*b*, that is, the direction in which the snap fittings are open and closed.

When shocks are given in this direction, a bending stress acts on the elastically displaceable portions of the first snap fittings 18*a* and 18*b*, and the first snap fittings 18*a* and 18*b* exhibit bending deformation with ease. Then, if the engaging portions 18*c* and 18*d* of the first snap fittings 18*a* and 18*b* should be dislocated, the hook faces of the first snap fittings 18*a* and 18*b* are inclined to the corners of the first receiving portions 6*g* and 6*h*, and brought into contact therewith. As a result, the frictional resistance of the contact portion becomes greater. Then, the elastic force of recovery of the first snap fittings 18*a* and 18*b* should provide a load large enough to resist such frictional resistance in order for the first snap fittings 18*a* and 18*b* to be restored to their predetermined position of engagement. The first snap fittings 18*a* and 18*b* find it difficult to return to the predetermined lock positions eventually. Then, if more shocks should be received in such condition, the engaging portions 18*c* and 18*d* of the first snap fittings 18*a* and 18*b* are caused to retract further, and the locks are dislocated after all.

Meanwhile, on the location where the second snap fittings 19*a* and 19*b* engage with the second receiving portions 6*e* and 6*f*, bending deformation occurs on the elastically displaceable portions of the second snap fittings 19*a* and 19*b* as in the case of the portion where the first snap fittings 18*a* and 18*b* engage with the first receiving portions 6*g* and 6*h*. At this time, however, the hook faces of the second snap fittings 19*a* and 19*b* are in contact with the second receiving portions 6*e* and 6*f* almost horizontally (almost in parallel). Thus, even if bending deformation occurs for the second snap fittings 19*a* and 19*b*, the contact angles for both of them exhibit almost no change. As a result, the frictional resistance that may act on the hook faces is small when the hook faces of the second snap fittings 19*a* and 19*b* move due to the occurrence of bending deformation, and the second snap fittings 19*a* and 19*b* are able to return to their predetermined lock position immediately.

In other words, the structure is arranged as described above so that (i) when the liquid discharge recording head 51 receives a shock load that acts in the bonding direction of the frame member 16 and the liquid path formation member 6, the first snap fittings 18*a* and 18*b* and the second snap fittings 19*a* and 19*b*, the extended directions of the elastically displaceable portions of which are different, are allowed to engage in order to have them work to hold the condition of engagement between the first snap fittings 18*a* and 18*b* and the elongated piece 31, and (ii) when the liquid discharge recording head 51 receives a shock load that acts in the direction in which the hooks of the snap fittings are caused to displace, the second snap fittings 19*a* and 19*b* hold the condition of engagement.

Also, the positional precision in which the frame member 16 and the flow path formation member 6 are bonded is determined mainly by the engagement between the first snap fittings 18*a* and 18*b* having the tensile strength sufficient to withstand the load that may act in the direction in which these members are separated, and the corresponding first receiving portions 6*g* and 6*h*, thus maintaining the relative positions thereof in high precision.

On the other hand, the locking of the engaged portion between the second snap fittings 19*a* and 19*b* and the second receiving portions 6*e* and 6*f* is not easily dislocated even when receiving any shock load that may act in the direction in which the hooks of snap fittings are caused to displace. Therefore, the engaged portion between the second snap fittings 19*a* and 19*b* and the second receiving portions 6*e* and 6*f* helps maintain the locking of the engaged portion between the first snap fittings 18*a* and 18*b* and the first receiving portions 6*g* and 6*h*.

In this respect, as another means for enhancing the resistance to the force of dropping shocks and to the repulsion of the sealing member 20, it may be possible to strengthen the rigidity of the elastically displaceable portion by making the thickness of the elastically displaceable portions of the snap fittings larger. In the case of this method, however, the space needed for connecting the frame member 16 and the flow path formation member 6 would have to become larger in accordance with the increase in size of the snap fittings. Moreover, with greater bending rigidity of the snap fittings, the assembling loads increase, so as to deteriorate the assembling performance accordingly.

In other words, in accordance with the present embodiment, it is possible to fix the connecting portion between the frame member 16 and the flow path formation member 6 strongly without increasing the thickness of the elastically displaceable portions of the snap fittings. As a result, the liquid discharge recording head 51 can be manufactured compactly at lower cost. Furthermore, the load that may be exerted is smaller when connecting frame member 16 and flow path formation member 6, leading to excellent productivity.

Next, the wiping operation will be described, with reference to FIG. 13 in addition to the figures discussed previously.

As described above, recording liquid is wet and adheres to the discharge ports and the recording liquid discharge surface 1*b* of the recording liquid elemental base plate 1, and also, to the face plane 3*a* of the sheet wiring base plate 3 of the recording apparatus, due to mist, satellites, or the like, generated when recording liquid is discharged from the liquid discharge recording head. Also, the recording liquid that remains after suction may adhere to the liquid discharge surface 1*b* and the face plane 3*a* at the time of the suction process or the like, in which recording liquid is suctioned from the discharge ports after capping.

Now, for the recording apparatus, a recovery unit that performs a wiping process is provided in order to remove the remaining recording liquid that has adhered to the recording liquid discharge surface 1*b* and the face plane 3*a*. The recovery unit is provided with a blade 41 that wipes off recording liquid by slidably moving on the recording liquid discharge surface 1*b* and the face plane 3*a*, and a carrier mechanism (not shown) that moves the blade 41.

The blade 41 is formed of rubber, elastomer, or the like, to be substantially in a flat form, and provided with elastic restoring power that enables the shape to be restored by elasticity when the leading end side is elastically deformed.

Also, if the width of the blade 41 is larger than the width (shorter side direction) of the sheet wiring base plate 3, there does not exist any area of the sheet wiring base plate 3 that the blade 41 cannot slide over for wiping, which makes it possible to execute the wiping operation effectively. Therefore, the width of the blade 41 should preferably be formed to be larger than the width of the sheet wiring base plate 3.

In FIG. 13, the statuses of the blade 41 designated by reference marks m1, m2, m3, and m4, indicate that the wiping operation begins, the blade passes the leading end portion 31*c* of the elongated piece 31, the actual wiping is in process (the blade begins to enter the face plane 3*a*), and the wiping operation terminates, respectively.

The blade 41 moves from the position (status $m_1$) where the wiping operation begins in the direction indicated by the arrow T in FIG. 13, and when the leading end side of the blade 41 is in contact with the outer wall face of the elongated piece 31, the leading end side of the blade 41 bends considerably to be elastically deformed along the leading end portion 31*c* of the elongated piece 31, thus moving slidably on the leading end portion 31*c* (status $m_2$).

Then, when the blade 41 moves further in the direction indicated by the arrow T, the leading end side enters the face plane 3*a* of the sheet wiring base plate 3 (status $m_3$).

The face plane 3*a* of the sheet wiring base plate 3 is recessed toward the flow path formation member 6 side, as compared to the leading end portion 31*c* of the elongated piece 31. Therefore, when the leading end side of the blade passes the leading end portion 31*c* of the elongated piece 31, the amount of deformation in the curved shape is reduced immediately after the step (the difference of the relative positions of the leading end portion 31*c* of the elongated piece 31 and the face plane 3*a*), and the leading end side of the blade 41 contacts and slides over the face plane 3*a*.

In this manner, when the sliding surface of the blade 41 on the leading end side moves from the leading portion 31*c* of the elongated piece 31 to the face plane 3*a*, the leading end side moves vigorously in the moving direction of the blade 41, because the leading end side itself tends to return to its original, undeformed, straight or upright configuration by its own elastic restoring force.

At this time, then, the leading end side of the blade 41 passes so as to jump over the end portion 3*c* of the sheet wiring base plate 3 without touching the end portion 3*c* thereof. Therefore, there is no possibility that it is hooked (caught) by the end portion 3*c* of the sheet wiring base plate 3. In other words, in accordance with the present embodiment, the liquid discharge recording head 51 has no drawback that the sheet wiring base plate 3 may be peeled off from the end portion 3*c* by the wiping operation of the blade 41, thus preventing the sheet wiring base plate 3 from being damaged.

In this respect, as described above, the length of the area that the leading end portion 3*c* of the blade 41 jumps over is determined by the material (elastic restoring power) of the blade 41, the speed of movement of the blade 41, and the difference (step) of the relative positions of the leading end portion 31*c* of the elongated piece 31 and the face plane 3*a* of the sheet wiring base plate 3, among some other factors.

Also, in accordance with the present embodiment, the step between the leading end portion 31*c* of the elongated piece 31 and the face plate 3*a* is set at 1.0 mm or less for the liquid discharge recording head 51. As a result, the leading end side of the blade 41 can be elastically deformed in good condition without any particular force, and the elastic deformation on the leading end side is made changeable smoothly and in a short period of time as well.

As described above, the blade 41 of the liquid discharge recording head 51 thus structured jumps over the inner wall face 31*e* of the elongated piece 31 and the leading end portion 3*c* of the sheet wiring base plate 3 when the blade 41 enters the face plane 3*a* of the sheet wiring base plate 3. After the jump, the leading end side of the blade 41 maintains a curved configuration. Therefore, the blade 41 is pressed against the face plane 3*a* of the sheet wiring base plate 3 immediately from the landing point of the leading end side, thus making it possible to begin the wiping operation promptly.

Under such circumstances, the liquid discharge recording head 51 is able to scrape off dust particles and recording liquid adhering to the circumference of the discharge ports precisely with the leading end side of the blade 41. Then, when the blade 41 has passed the face plane 3*a* of the sheet wiring base plate 3 completely, the blade 41 returns to its original, undeformed, straight or upright configuration (status m4) by its own elastic restoring power.

In accordance with the present embodiment, the recording apparatus makes it possible to form good images by stabilizing the discharge operation of the recording liquid by cleaning the face plane 3*a* of the sheet wiring base plate 3 and the circumference of discharge ports by means of a series of the wiping operations described above.

Also, the inner wall 31*e* of the elongated piece 31 is positioned on the upstream side of the starting point of the wiping operation. Therefore, recording liquid carried by the leading end side of the blade 41 is not pooled in the vicinity of the inner wall face 31*e*.

In this respect, there is no wall or extrusion that protrudes from the face plane 3*a* with the exception of the leading end portion 31*c* of the elongated piece 31 on the circumference of the sheet wiring base plate 3 as a matter of course, so as to prevent the remaining recording liquid, which flows out in the widthwise direction of the blade 41 and cannot be removed, or the remaining recording liquid and other matter that cannot be removed by a one-time wiping operation, from stagnating on the area outside of the sliding contact area of the blade 41 when the wiping operation is performed.

Also, it is preferable to arrange the structure so that (i) when the leading end side of the blade 41 is in contact with the elongated piece 31 and bent, the width of the elongated piece 31 is made larger than the width of the blade 41 in order to bend it to be elastically deformed evenly over the entire area of the widthwise direction of the blade 41, and (ii) the entire area over the blade width is in contact with the elongated piece 31.

Next, with reference to FIG. 14 and FIG. 15, the description will be made of the method for positioning the liquid discharge recording head 51 on the carriage 61 provided for the recording apparatus.

In FIG. 14 and FIG. 15, only a part of the bottom portion of the carriage is schematically represented, not the entire body of the carriage, for the sake of convenience.

On the bottom portion of the carriage, there is provided the opening 61*a*, which enables the liquid discharge recording head 51 to be inserted. On the inner wall face of the opening 61*a*, receiving portions 61*b* and 61*c* are arranged to receive the cylindrical surface portions 2*a* and 2*b* (see FIG. 5) on the liquid discharge recording head 51 side, and on the upper face, receiving surfaces 61*d* and 61*e* are arranged to support the liquid discharge recording head 51 in the direction in which it is inserted.

When the liquid discharge recording head 51 is lowered to the bottom face portion of the carriage and inserted, the liquid discharge recording head 51 is pressed in the directions indicated by arrows A, B, and C in FIG. 14 by pressurizing means (not shown) arranged on the carriage side. Therefore, the boss 6*a* of the liquid discharge recording head 51 abuts against the receiving surfaces 61*d* and 61*e* of the carriage, and the cylindrical surface portions 2*a* and 2*b* of the liquid discharge recording head 51 abut against the receiving portions 61*b* and 61*c* of the carriage. Further, the bosses 6*b* ofthe liquid discharge recording head 51 abut against the predetermined receiving portions (not shown) on the carriage side. In this manner, the liquid discharge recording head 51 is positioned on the carriage in high precision.

In this respect, the recording apparatus is structured to enable the frame member 16 to receive all the pressure that acts in the directions indicated by the arrows A, B, and C in FIG. 14 by pressure means provided for the carriage, and then, even if it is attempted to provide a large liquid storing means (i.e. to make the common liquid chamber 17 larger) for the liquid discharge recording head 51, which necessitates a head in which the frame member 16 is made larger, there is no need for the recording unit 15 or the flow path formation member 6 to be made larger, thus making it possible to manufacture the liquid discharge recording head 51 at lower cost.

Also, the cylindrical surface portions 2*a* and 2*b* (the first reference surface) of the first plate 2 serving as the assembling reference of the recording element base plate 1 ,can also be used as a reference portion for positioning the installation of the liquid discharge recording head 51 on the carriage. Therefore, the amount of inclination of the recording element base plate 1 (the discharge port array) after the liquid discharge recording head 51 is mounted on the carriage can be determined by only the value of the adjustment precision of the recording element base plate 1 based on the first reference surface of the first plate 2, added to the value of the abutting precision of the first reference surface and the receiving surfaces 61*b* and 61*c* of the carriage, hence making it possible to position the liquid discharge recording head 51 on the carriage for mounting, with extremely high precision.

Further, if the first plate 2 is formed of a rigid material, such as ceramics, it becomes possible to improve the dimensional accuracy and geometric accuracy of the first plate 2 still more, thus significantly enhancing the assembling precision of the recording element base plate 1.

Also, if the first plate 2 is formed of a rigid material, there is no possibility that the load that may be exerted will deform the first reference surface of the first plate 2 when the liquid discharge recording head 51 is mounted on the carriage. As a result, the precision of the abut-positioning becomes extremely high. Moreover, even if the liquid discharge recording head 51 is often mounted on or removed from the carriage, the reference surface of the first plate 2 continues to provide excellent resistance to wear. Therefore, the inclination accuracy of the discharge port arrangement portion of the liquid discharge recording head can be reproduced in good condition when mounted on the carriage, and positioning is performed precisely, thus enhancing the reliability of the recording apparatus as a whole.

Also, the first plate 2 is formed of alumina having high capacity for heat radiation. Then, even if the liquid discharge recording head is arranged in high density, whereby the temperature rises easily, the temperature characteristics of the liquid discharge recording head as a whole are improved. Furthermore, being excellent in chemical resistance with high rigidity, alumina makes it possible to provide the performance of highly precise machining. With alumina, the various properties required for the first plate 2 are satisfied, and it serves as a preferable material for the first plate 2.

As described above, when the liquid discharge recording bead 51 is mounted on the carriage, reference portions for positioning in all the three-dimensional directions are provided for the recording unit 15. With this arrangement, it becomes possible to reduce the errors that may be brought about by heaping one member on another, and the accumulated dimensional errors of the members provided for positioning the recording element base plate 1 with the first plate 2 or the flow path formation member 6. As a result, the positioning accuracy is significantly enhanced for the discharge ports when the liquid discharge recording head 51 is mounted on the carriage.

Then, as described above, for the recording unit 15, the functions required for the liquid discharge recording head 51 are intensively arranged. Therefore, with the selection of materials and the adoption of mechanical structures that provide high mechanical strength in high precision, the reliability of the dimensional reference portions is significantly enhanced for the liquid discharge recording head 51.

For the frame member 16, on the other hand, it is possible to select inexpensive materials within a range that provides desired properties for the first snap fittings 18*a* and 18*b*, the second snap fittings 19*a* and 19*b*, and the elongated piece 31. Therefore, the required functions of the recording unit 15 are intensively formed with a minimum size. Also, inexpensive material is used for all the other portions of the frame member 16 as required. In this way, a high-performance liquid discharge recording head 51 can be manufactured at lower cost Also, the inclination of the discharge ports in the arrangement direction is most important in positioning the liquid discharge recording head 51. Here, it is possible to set the assembling reference of the recording element base plate 1 and the installation reference of the liquid discharge recording head 51 equally with respect to the carriage. Therefore, even for the recording apparatus for which the liquid discharge recording head 51 is attached to and detached from the carriage 61 frequently, the installation of the discharge ports can be maintained in high precision at alltimes.

Furthermore, with the structure arranged to assemble all the members that form the liquid discharge recording head with reference to the positioning reference, which is made applicable at the time of mounting on the carriage, it becomes possible to manufacture the liquid discharge recording head 51 with still higher precision.

So far, one mode of the liquid discharge recording head and recording apparatus of the present invention has been described. The present invention is of course applicable to any mode of the recording apparatus in which only a single liquid discharge recording head 51 is mounted on the carriage or plural liquid discharge recording heads 51 are mounted on the carriage.

Also, the structure may be arranged so that the positioning references in all the three-dimensional directions are arranged for the flow path formation member 6 when the liquid discharge recording head 51 is mounted on the carriage. In other words, with the positioning references being put together for one member, it is made possible to clearly separate members in high precision and members in low precision for the enhancement of productivity.

Also, the elastically displaceable portions of the second snap fittings 19*a* and 19*b* extend in a direction at right angles to the connecting direction of the frame member 16 and the flow path formation member 6. However, the same effect is obtainable by a structure in which the elastically displaceable portions of the second snap fittings 19*a* and 19*b* extend in a direction inclined at an angle of 45° or more to the connecting direction of the frame member 16 and the flow path formation member 6. For securing the bonding condition more reliably, however, such direction should preferably incline at an angle close to ninety degrees.

Here, in accordance with the present embodiment, the description has been made of a structure in which the first snap fittings 18*a* and 18*b* and the second snap fittings 19*a* and 19*b* are provided for the frame member 16, and the first receiving portions 6*g* and 6*h* and the second receiving portions 6*e* and 6*f* are provided for the flow path formation member 6. However, the same effect is also obtainable by a structure in which, contrary to the arrangement described above, the receiving portions are provided for the frame member 16, and the snap fittings are provided for the flow path formation member 6.

Also, in accordance with the present embodiment, the recording unit 15 and the frame member 16 are connected with the sealing member 20 being nipped between them. However, the present invention is also applicable to the mode in which the liquid discharge recording head is structured without any arrangement of the sealing member 20 on the connecting portion, but rather is structured to be airtightly closed by use of sealant or the like.

(Second Embodiment)

For the first embodiment, the description has been made of a liquid discharge recording head that is structured to supply recording liquid from an external recording liquid storing tank to a common liquid chamber connected to the flow path formation member. For the present embodiment, the description will be made of a liquid discharge recording head structured so as to enable the flow path formation member to detachably hold a holder member (recording liquid supply supporting member), and to detachably mount a cartridge tank on this holder. In this respect, the flow path formation member is fundamentally the same as the flow path formation member that has been described in accordance with the first embodiment. Therefore, the detailed description thereof will be omitted. The same reference marks used in the first embodiment are also used for the same constituents as those described in the first embodiment.

Figure 16B:
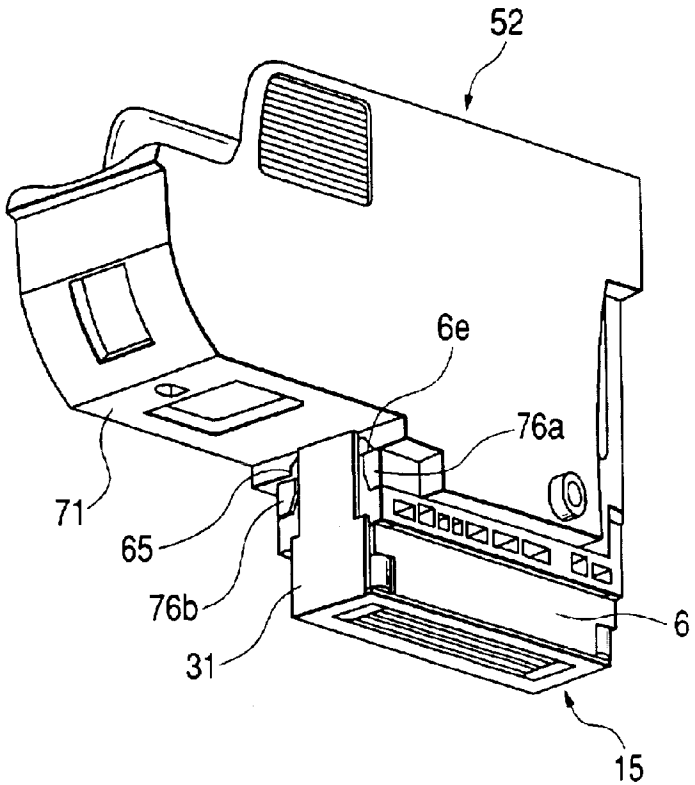
FIGS. 16A and 16B are perspective views that illustrate the outer appearance of the liquid discharge recording head in accordance with a second embodiment of the present invention.
Figure 16A:
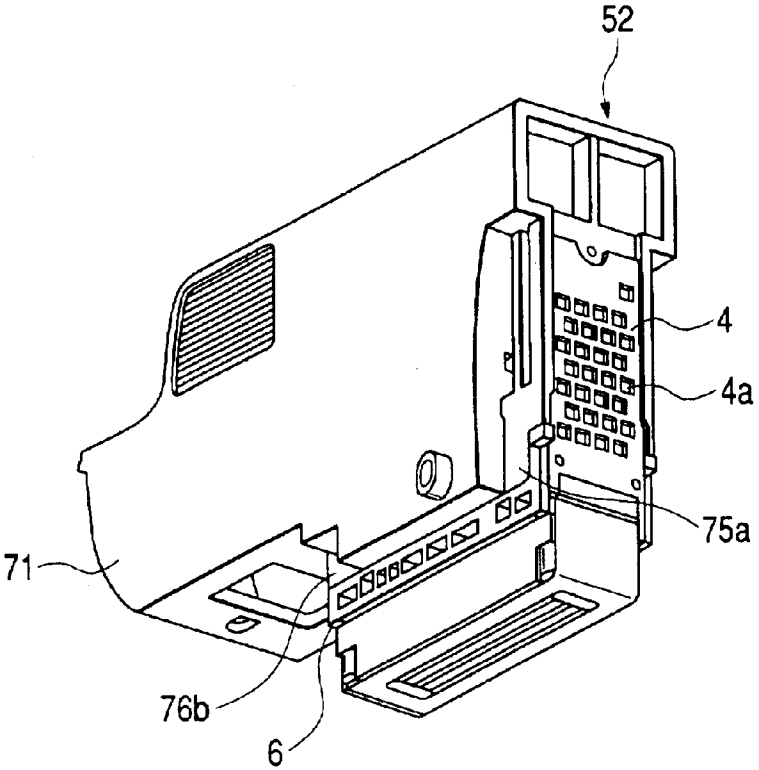
Figure 17:
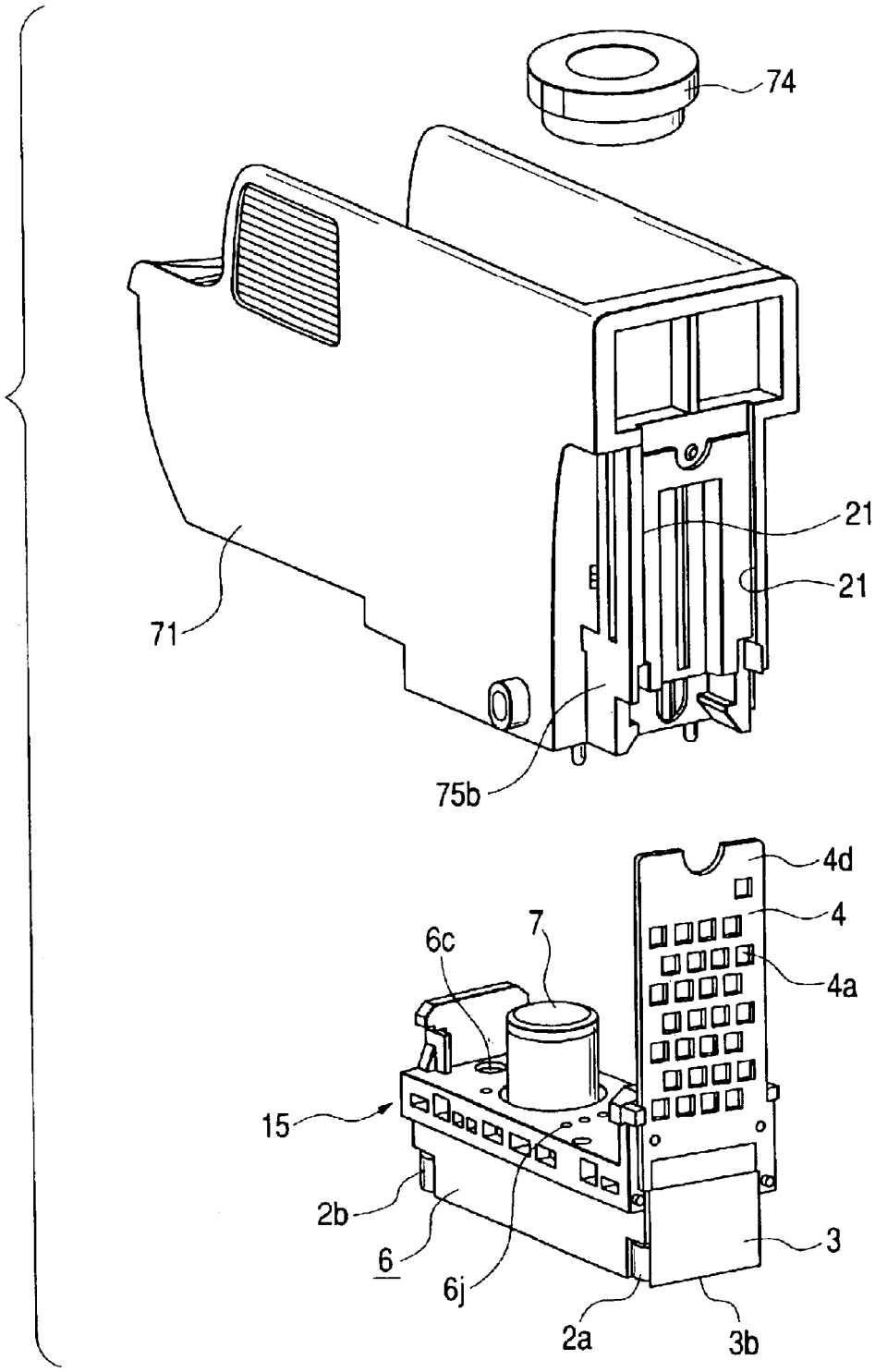
FIG. 17 is an exploded perspective view that shows the liquid discharge recording head represented in FIGS. 16A and 16B.
Figure 18:
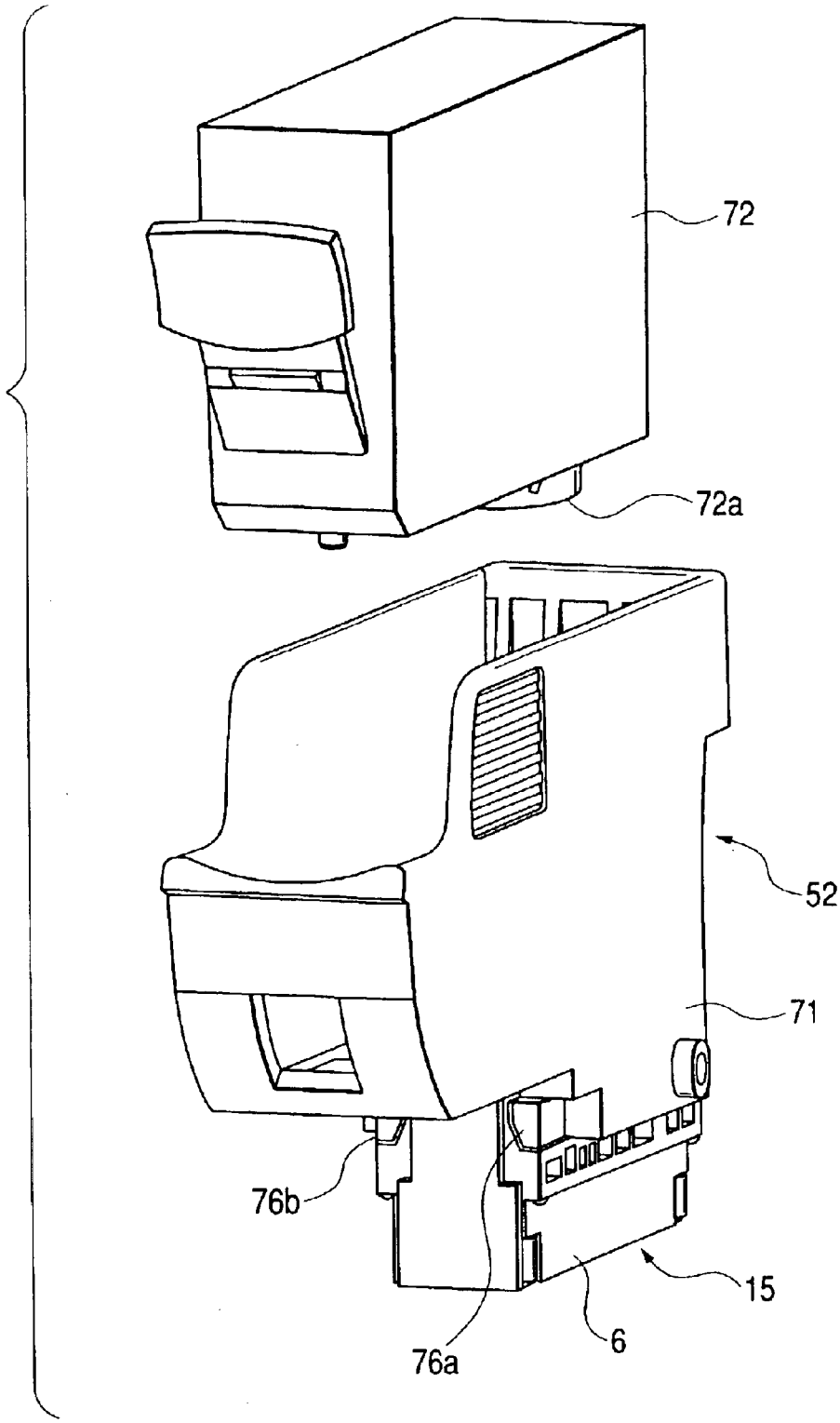
FIG. 18 is a perspective view that shows the outer appearance of the holder member and the cartridge tank.
Figure 19:
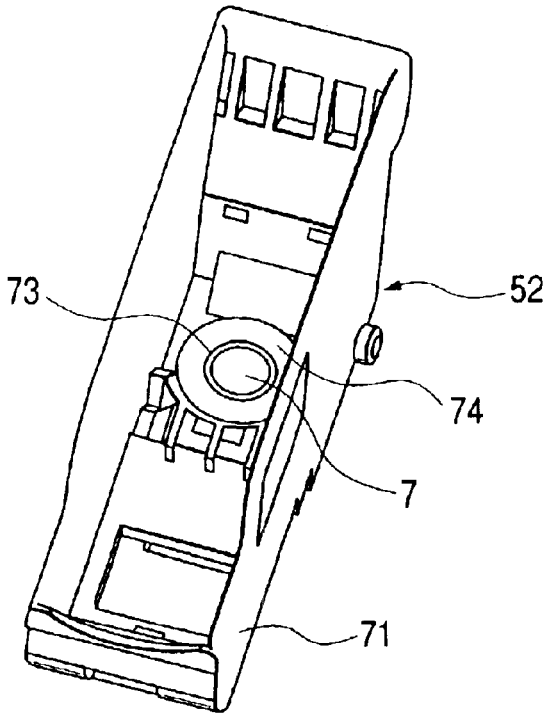
FIG. 19 is a perspective view that shows the outer appearance of the holder member, observed from above.
Figure 20:
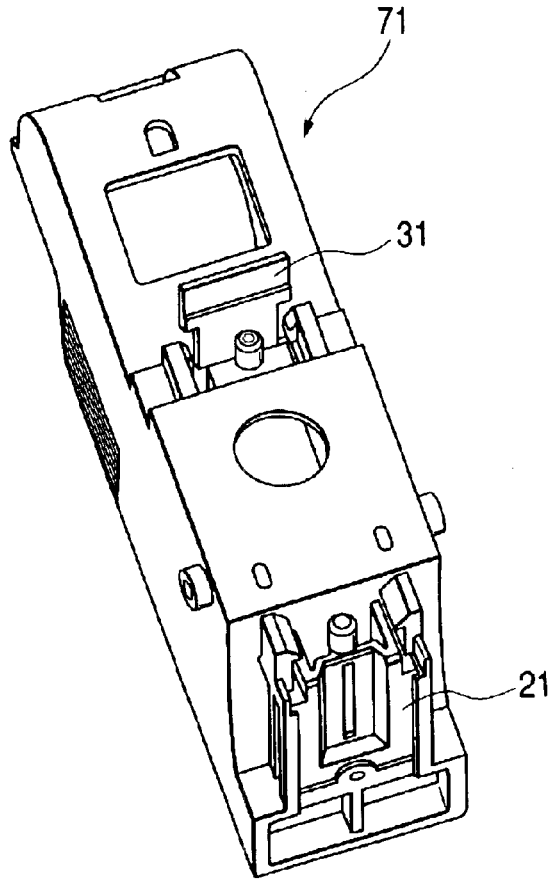
FIG. 20 is a perspective view that shows the outer appearance of the holder member, observed from below.
Figure 21:
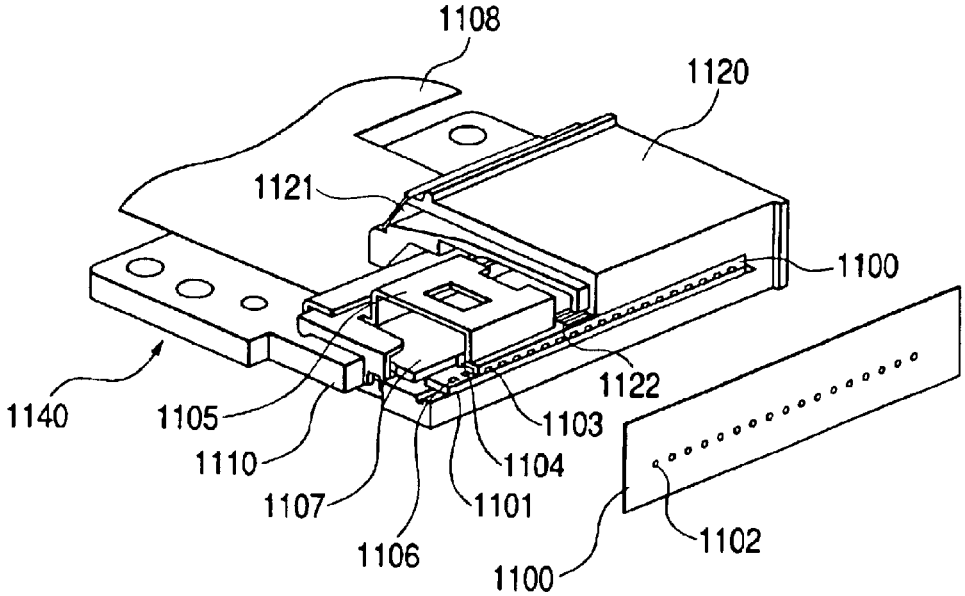
FIG. 21 PRIOR ART
FIG. 21 is a perspective view that shows one structural example of the conventional liquid discharge recording head.
Figure 22:
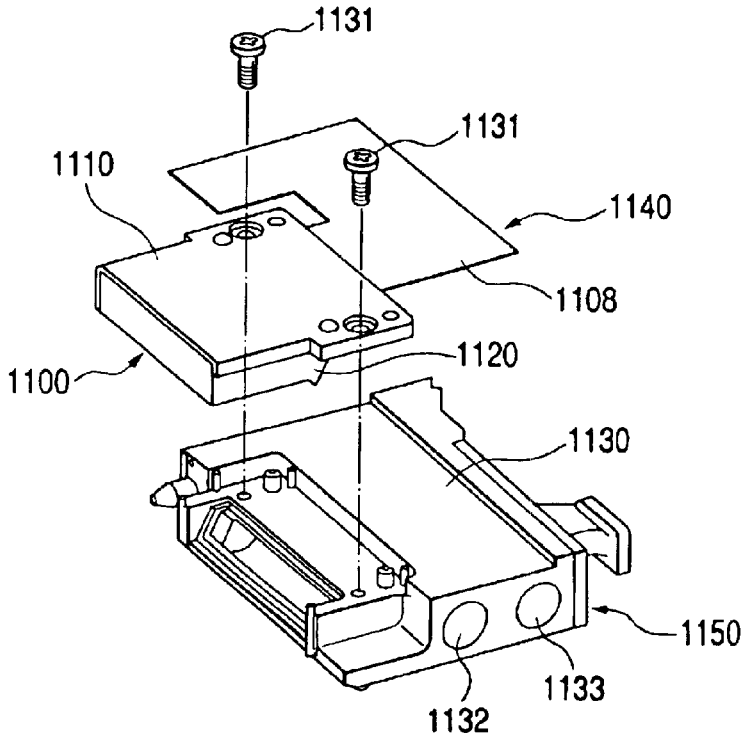
FIG. 22 PRIOR ART
FIG. 22 is an exploded perspective view that shows one structural example of the conventional liquid discharge recording head.
Figure 23:
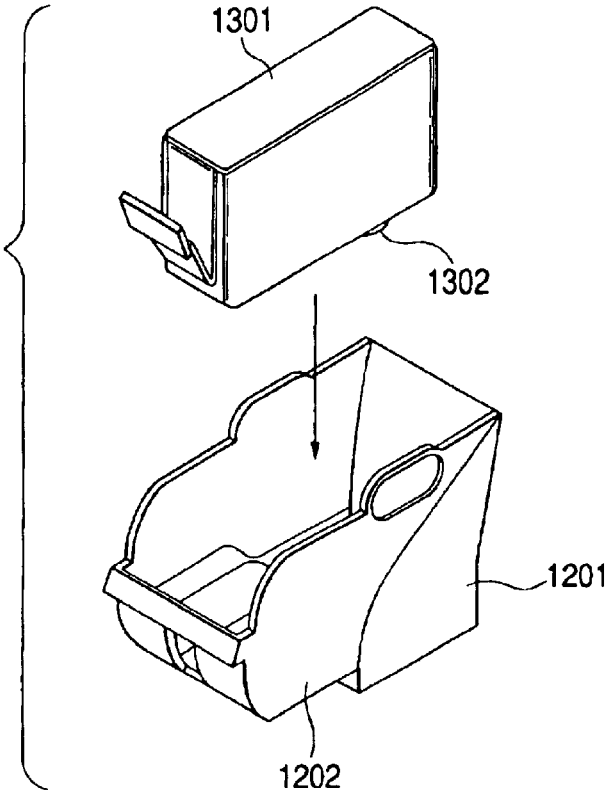
FIG. 23 PRIOR ART
FIG. 23 is a perspective view that schematically shows one conventional example of the liquid discharge recording head having the exchangeable recording liquid storing portion.
Figure 24:
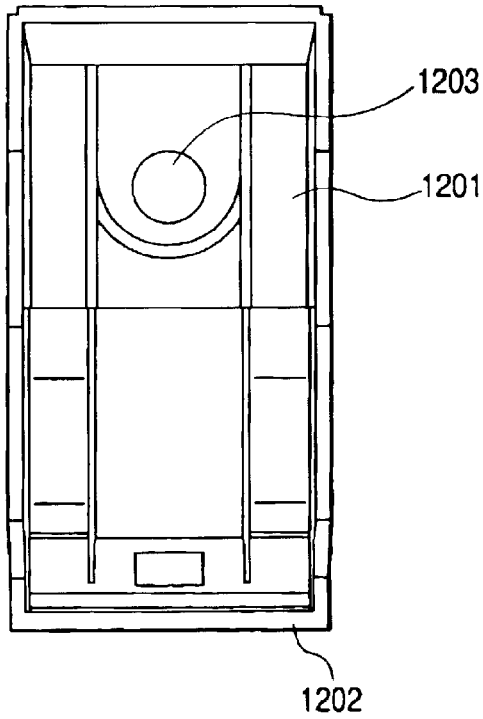
FIG. 24 PRIOR ART
FIG. 24 is a plan view of the liquid discharge recording head represented in FIG. 23, observed from above.

FIG. 16A and FIG. 16B are perspective views that illustrate the outer appearance of the liquid discharge recording head in accordance with the present embodiment. FIG. 17 is an exploded perspective that shows the liquid discharge recording head represented. FIG. 18 is a view that shows the outer appearance of the holder member and the cartridge tank. FIG. 19 is an upper perspective view that shows the holder member. FIG. 20 is a lower perspective view that shows the outer appearance of the holder member.

In accordance with the present embodiment, the liquid discharge recording head 52 holds the flow path formation member 6 having the same structure as the one described in the first embodiment, and the cartridge tank 72 installed thereon with recording liquid contained therein, while having the holder member 71, which is made easily attachable and detachable at the time of exchanging cartridge tanks 72.

For the holder member 71, a joint portion 73 (of the flow path formation member 6) is provided, and in the state where the cartridge tank 72 is installed on the holder member 71, the recording liquid supply port 72*a* of the cartridge tank 72 is connected with the joint portion 73, and recording liquid in the cartridge tank 72 is supplied into the recording unit 15 through the porous member 7 provided for the joint portion 73.

In this structure, a sealing rubber 74 is arranged on the circumference of the joint portion 73, and in the state in which the cartridge tank 72 is installed on the recording unit 15, it is possible for the recording liquid supply port 72*a* of the cartridge tank 72 to be in contact with the sealing rubber 74, while pressing against it.

In this manner, with the cartridge tank 72 installed, it is made possible to prevent recording liquid from leaking, and also, to prevent it from being evaporated from this contact portion. It is necessary that the sealing rubber 74 used for such purpose be greatly deformable with ease by a slight load, in order to provide a high sealing capability. Therefore, a material having a soft rubber hardness should be selected.

The holder member 71 is connected with the flow path formation member 6 of the recording unit 15. Then, while the bosses 16*a* and 16*b* (see FIG. 10) arranged for the holder member 71 are inserted into the holes 6*c* and 6*d*, which are arranged for the flow path formation member 6 for positioning, first snap fittings 75*a* and 75*b* and second snap fittings 76*a* and 76*b*, which are arranged for the holder member 71, are hooked by the first receiving portions 6*g* and

6*h* and the second receiving portions 6*e* and 6*f*, which are arranged for the flow path formation member 6, thus connecting and fixing the holder member 71 and the flow path formation member 6 completely.

In this respect, the specific method of connection between the holder member 71 and the flow path formation member 6 and the effect that may be produced thereby are exactly the same as the method adopted for connecting the flow path formation member 6 and the frame member 16 for the liquid discharge recording head 51 of the mode in which recording liquid is supplied from the external recording liquid storing chamber as described earlier. Therefore, the detailed description thereof will be omitted.

As described above, the flow path formation member 6 is capable of dealing with the frame member 16, in which recording liquid is supplied from the external recording liquid storing tank 122, and with the holder member 71 having the cartridge tank 72 with recording liquid contained therein, which is installed on the holder. Therefore, it is possible to attempt the common use of the recording unit 15 for the holder member 71 and the frame member 16 described in conjunction with the first embodiment.

As has been described above, for the liquid discharge recording head of the present invention, the bonding of the recording unit and the holding member that holds and fixes the storing tank, or the recording liquid supply supporting member, which serves as either one of the recording liquid storing unit members, is effectuated so that the direction in which the first snap fittings engage with the first receiving portions and the direction in which the second snap fittings engage with the second receiving portions intersect each other. Therefore, even if a shocking force is exerted by dropping of the recording head or the like, and a force is given in a direction such that either one of the engagements is released, it is made difficult for such force to be given in the direction in which the other engagement would be released, thus keeping the other engagement intact Consequently, simultaneous separation of both engagements may be prevented.

Also, the liquid discharge recording head of the present invention is bonded by the use of snap fittings. Therefore, as compared with the cases in which screws, bonding agents, or other means are used for bonding, the costs of manufacture can be reduced. Also, it is possible to share the recording unit of the liquid discharge recording head of the present invention, which deals with the core of recording liquid discharges, for use with the comparatively inexpensive holding member and the recording liquid storing unit. This arrangement is advantageous in that the cost of the liquid discharge recording head as a whole is made favorable.

What is claimed is:

1. A liquid discharge head comprising:

a liquid discharge unit on a surface of which a liquid discharge port for discharging liquid is provided;

a liquid storing unit for storing liquid supplied to said liquid discharge unit, said liquid storing unit being connected to said liquid discharge unit from a side opposite to said surface;

a first coupling mechanism for coupling said liquid discharge unit and said liquid storing unit upon an engagement movement in a coupling direction of said liquid discharge unit and said liquid storing unit, said first coupling mechanism having a first snap fitting provided on one of said units and extending in the coupling direction and a first receiving portion provided on another of said units, and upon engagement of said units, a slanted surface provided on said first receiving portion elastically deforms said first snap fitting in a direction different from the coupling direction so as to couple a hook-like portion of said first snap fitting with said first receiving portion; and a second coupling mechanism for coupling said liquid discharge unit and said liquid storing unit upon the engagement movement in the coupling direction of said units, said second coupling mechanism having a second snap fitting provided on one of said units and extending in a direction perpendicular to the coupling direction and a second receiving portion provided on another of said units, and upon the engagement of said units, a slanted surface provided on said second receiving portion elastically deforms said second snap fitting in a direction different from the coupling direction so as to couple a hook-like portion of said second snap fitting with said second receiving portion.

2. A liquid discharge head according to claim 1, wherein the extended direction of said first snap fitting intersects the extended direction of said second snap fitting at an angle of 45° or more.

3. A liquid discharge head according to claim 2, wherein the extended direction of said first snap fitting is substantially orthogonal to the extended direction of said second snap fitting.

4. A liquid discharge head according to claim 1, comprising a pair of said first snap fittings, a pair of said first receiving portions, a pair of said second receiving portions, and a pair of said second snap fittings.

5. A liquid discharge head according to claim 1, wherein either one of a holding member for holding and fixing a storing tank containing recording liquid therein and a recording liquid storing unit for provisionally retaining recording liquid supplied from the outside is coupled to said liquid discharge unit as said liquid storing unit.

6. A liquid discharge head according to claim 1, wherein a sealing member is nipped on a connecting portion of said liquid storing unit and said liquid discharge unit.

7. A liquid discharge head according to claim 1, wherein, in the vicinity of said second snap fitting, an elastic engaging portion is provided extending in the same direction as said first snap fitting.

8. A liquid discharge head according to claim 1, wherein said hook-like portion of said first snap fitting fixes said units in the coupling direction.

9. A liquid discharge head according to claim 1, wherein said hook-like portion of said second snap fitting fixes said units in an extending direction of said second snap fitting perpendicular to the coupling direction.

* * * * *

UNITED STATES PATENT AND TRADEMARK OFFICE

CERTIFICATE OF CORRECTION

PATENT NO. : 6,957,883 B2
DATED : October 25, 2005
INVENTOR(S) : Yukuo Yamaguchi et al.

It is certified that error appears in the above-identified patent and that said Letters Patent is hereby corrected as shown below:

Column 1,
Line 45, “clement” should read -- element --.
Line 52, “recordingelements.” should read -- recording elements. --.

Column 3,
Line 51, “arca,” should read -- area, --.

Column 4,
Line 18, “widelyused.” should read -- widely used. --.

Column 25,
Line 10, “cost” should read -- cost. --.

Column 27,
Line 37, “intact” should read -- intact. --.

Signed and Sealed this

Sixteenth Day of May, 2006

JON W. DUDAS
*Director of the United States Patent and Trademark Office*